US005627436A

United States Patent [19]

Suzuki et al.

[11] Patent Number: 5,627,436

[45] Date of Patent: May 6, 1997

[54] MULTI-ELECTRON BEAM SOURCE WITH A CUT OFF CIRCUIT AND IMAGE DEVICE USING THE SAME

[75] Inventors: Hidetoshi Suzuki; Ichiro Nomura, both of Atsugi; Tetsuya Kaneko, Yokohama; Haruhito Ono, Minami Ashigara, all of Japan

[73] Assignee: Canon Kabushiki Kaisha, Tokyo, Japan

[21] Appl. No.: 517,658

[22] Filed: Aug. 22, 1995

Related U.S. Application Data

[63] Continuation of Ser. No. 314,966, Sep. 29, 1994, abandoned, which is a continuation-in-part of Ser. No. 42,586, Apr. 5, 1993, abandoned.

[51] Int. Cl.[6] ..... H05B 41/14; G09G 3/10

[52] U.S. Cl. ..... 315/169.1; 315/169.2

[58] Field of Search ..... 315/167, 168, 315/169.1, 169.2, 169.3, 169.4, 326, 334, 335, 336, 337, 338, 339

[56] References Cited

U.S. PATENT DOCUMENTS 4,315,259 2/1982 McKee et al. ..... 315/169.4 X
4,719,388 1/1988 Oess ..... 315/169.1
5,155,413 10/1992 Bozzer et al. ..... 315/169.1
5,210,472 5/1993 Casper et al. ..... 315/169.4 X

FOREIGN PATENT DOCUMENTS 4104438 4/1992 Japan .

*Primary Examiner*—David Mis
*Attorney, Agent, or Firm*—Fitzpatrick, Cella, Harper & Scinto

[57] ABSTRACT

A multi-electron beam source comprising an electron-emitting element part includes: a plurality of electron-emitting elements provided two-dimensionally in a matrix-like arrangement on a substrate, with opposing terminals of the electron-emitting elements arranged adjacently in the column direction thereof being electrically connected to each other, terminals on the same side of all the electron-emitting elements in the same row being electrically connected, and the plurality of electron-emitting elements being arranged in "m" rows, "m" representing a number of two or more. In addition, a driving circuit drives the electron-emitting element part, grid electrodes modulate electron beams emitted from the electron-emitting elements, and a cut-off circuit cuts off the electron beams caused by spike noises superposed on driving pulse generated by the driving circuit part.

12 Claims, 26 Drawing Sheets

SERIAL IMAGE DATA
SHIFT REGISTER
104
LINE MEMORY
105
SEE FIG.4B
106
107
D/A CONVERTER
DISPLAY PANEL
101
102
103
TIMING CONTROL CIRCUIT
TSFT
TMRY
TOFF
TSCAN
(8BIT DATA)
(8BIT DATA)

X
Y
GRID ELECTRODE TERMINAL
GN
GN-1
G3
G2
G1
FP
Ev
Gh
GR
Em-1
Em
Em+1
VC
Ex1
Ex2
Exm-1
Exm
Exm+1
S
SEE FIG.5B
Em
108
110
109
Em+1

SERIAL IMAGE DATA
SHIFT REGISTER
204
LINE MEMORY
205
SEE FIG. 15B
206
207
D/A CONVERTER
DISPLAY PANEL
201
202
203
TIMING CONTROL CIRCUIT
(8BIT DATA)
(8BIT DATA)
TSFT
TMRY
TOFF
TSCAN
VH
VE
VGN
VG1
G1
G2
GN
EV
EXm1
EXm1'
EXp1
EXp2
S1
S2
ID1
IDN
I'D1
I'DN
I''D1
I''DN

CATHODE SIDE WIRING
EV
EXm1
EXm2
EXm(ℓ-3)
EXm(ℓ-2)
EXm(ℓ-1)
EXmℓ
FP
GN
GN-1
GRID ELECTRODE TERMINAL
G3
G2
G1
X
Y
VC
EXp1
EXp2
Gh
GR
Em(ℓ-1)
Emℓ
SEE FIG.16B
Epℓ
S
EX(ℓ-3)
EXp(ℓ-2)
EXp(ℓ-1)
EXpℓ
ANODE-SIDE WIRING
Epℓ
Emℓ
ES

MULTI-ELECTRON BEAM SOURCE WITH A CUT OFF CIRCUIT AND IMAGE DEVICE USING THE SAME

This application is a continuation of application Ser. No. 08/314,966, filed Sep. 29, 1994, now abandoned, which is a continuation-in-part of application Ser. No. 08/042,586, filed Apr. 5, 1993, now abandoned.

BACKGROUND OF THE INVENTION

1. Field of the Invention

The present invention relates to a multi-electron beam source and to an image display device using the same, having a large number of electron-emitting elements arranged in a plurality of rows.

2. Belated Background Art

A cold cathode element disclosed, for example, by M. I. Elinson et al. is known as the element which is capable of emitting electrons with a simple structure (Radio Engineering Electron Physics, Vol. 10, pp. 1290–1296, 1965).

The element is based on the phenomenon that electron emission occurs when an electric current is caused to flow through a film having a small area formed on a substrate in parallel to the film surface thereof, which is generally called a surface conduction type electron-emitting element.

Known surface conduction type electron-emitting elements include: one using an $SnO_2$(Sb) thin film developed by Elinson et al. as described above; one based on an Au film (G. Dittmer: "Thin Solid Films" Vol. 9, p. 317 (1972)); one based on an ITO film (M. Hartwell and C. G. Fonstad: IEEE Trans. ED Conf., p. 519 (1975)); one based on carbon film (Hisashi Araki et al.: Shinku, Vol. 26, No. 1, p. 22 (1983)): and one using Pd, in place of the above $SnO_2$, Au or ITO, as a material of the electron-emitting portion (Japanese Patent Application Laid-Open No. 1-279542).

In addition to the surface conduction type electron-emitting elements, reported are a cold cathode element such as an MIM type electron-emitting element, and a finely fabricated field emission electron gun.

These cold cathode elements have advantages of high electron emission efficiency, a simple structure for easy fabrication, and practicability of arrangement of a large number of elements in array on a single substrate.

The inventors of the present invention already proposed a device, as shown in FIG. 1, in which a large number of such cold cathode elements are densely arranged in an array and the resistance of the electric wiring therefor is reduced. In FIG. 1, ES represents an electron-emitting element, and $E_1$ to $E_{m+1}$ denote respectively a distributing electrode, the electron-emitting elements and the distributing electrodes forming an array having m rows of electron-emitting elements. This functional region is called an electron-emitting element part.

In this device, any one of the rows may be selectively driven. For example, when a driving voltage $V_E$[V] is applied only to an electrode $E_1$ and 0[V] is applied to electrodes $E_2$ to $E_{m+1}$, the driving voltage $V_E$[V] is applied only to the elements in the first row, whereby only the elements in that row are caused to emit electron beams. Generally, in order to drive the n-th row, it suffices to apply $V_E$[V] to electrodes $E_1$ to $E_n$ and to apply 0[V] to electrodes $E_{n+1}$ to $E_{m+1}$, and, in the case where none of the columns is to be driven, it suffices to bring all of $E_1$ to $E_{m+1}$ to the same potential (e.g., 0[V]).

Such a multi-electron beam source capable of row-sequential drive is highly promising for use for a flat panel CRT, since an XY-matrix type of electron beam source may easily be formed by providing grid electrodes perpendicularly to the rows of the elements.

In driving the multi-electron beam source as shown in FIG. 1, a problem is involved that a spike-like voltage arises and is applied undesirably to the rows of elements which should be halting. This problem is explained below by reference to FIG. 2 and FIG. 3.

FIG. 2 shows a typical example of the circuit for driving the multi-electron beam source shown in FIG. 1. In FIG. 2, switching elements such as field-effect transistors (FET) are connected in the manner of a totem pole to the distributing electrodes represented by $E_1$ to $E_{m+1}$, where, by suitably controlling gate signals $GP_1$ to $GP_{m+1}$ and $GN_1$ to $GN_{m+1}$ of the respective FET, 0[V] (ground level) or $V_E$[V] may be selectively applied to each distributing electrode. This functional region is called a driving circuit part.

FIG. 3 is a graph exemplifying the voltage to be applied to each section for driving the multi-electron beam source shown in FIG. 2. In FIG. 3, the folded line ① shows the change of the driving state in the case where the rows of the elements are sequentially driven with interposition of halting periods, starting from the first row. Such driving is practiced in use for a multi-electron beam source for a flat panel CRT.

In such driving, rectangular voltage pulses of $V_E$[V] are applied to the distributing electrodes $E_1$ to $E_4$ in lapse of time as indicated by the folded lines ② to ⑤ in FIG. 3. For example, the difference in voltage between $E_1$ (folded line ②) and $E_2$ (folded line ③) is applied to the first-row elements. Thus the voltage $V_E$ is applied to the first-row elements during the first-row driving period as indicated by the driving state line ①. Thereafter in a similar manner, the difference in voltage between $E_2$ (folded line ③) and $E_3$ (folded line ④) is applied to the second-row elements, and the difference in voltage between $E_3$ (folded line ④) and $E_4$ (folded line ⑤) is applied to the third-row elements.

However, according to actual observation with an oscilloscope, as shown by the folded lines ⑥ and ⑦ in FIG. 3, a spike-like voltage SP(+) (indicated by the dotted line) or SP(−) (indicated by the solid line) is applied at the instant when another row of the elements is turned on or off.

Such a spike-like voltage applied to the electron-emitting elements tends to cause undesired emission of electron beams in the halting period. If such a device is used for an electron beam source of a flat panel CRT, undesired light emission is caused by the spike-like voltage at the time when light should not be emitted, whereby the image contrast is impaired disadvantageously.

Such spike-like voltage arises presumably because the timing of turn-on or turn-off of respective electrodes deviates from the intended time shown by the aforementioned folded lines ② to ⑤. Specifically, in the first element row, the electrodes $E_1$ and $E_2$ should be simultaneously switched as 0[V]→$V_E$[V] (or $V_E$[V]→0[V]) at the time where the second or subsequent element row is to be turned on (or off). If the timing of turn-on or turn-off deviates from the ideal timing, a spike-like voltage comes to be applied.

The polarity of the spike-like voltage, a positive voltage spike SP(+) or a negative voltage spike SP(−), depends on which one of $E_1$ or $E_2$ the voltage applied earlier to.

The deviation in timing of the voltage application to each electrode results from the following causes: deviation in timing of the gate signals $GP_1$ to $GP_{m+1}$ and $GN_1$ to $GN_{m+1}$ of FET's of the driver circuit as shown in FIG. 3 described above, and variation of time of switching owing to variation in characteristics of each FET.

Complete elimination of the spike-like voltage SP by adjustment of the timing of the gate signals and/or control of the variation in FET characteristics is extremely difficult technically, and is considered not to be practical.

As described above, various problems are involved in the arrangement of a number of cold cathode elements as shown in FIG. 1. Similar problems are involved in arrangements different from that of FIG. 1. For example, multi-electron beam sources shown in FIG. 12 and FIG. 18 also involve problems of occurrence of unintended application of spike-like voltage to the electron-emitting elements.

The multi-electron beam sources shown in FIG. 12 will be explained.

FIG. 12 shows an arrangement of L rows of electron-emitting elements, in which ES denotes an electron-emitting element, and $E_{p1}$ to $E_{pl}$ and $E_{m1}$ to $E_{ml}$ denote wiring electrodes. In this device, each of the L rows of the elements are capable of being driven in arbitrary combination thereof. A desired row of elements can be selectively driven by application of voltage $V_E$ [V] to the electrode among $E_{p1}$ to $E_{pl}$ for the row of elements to be driven and application of 0 [V] to the electrodes for the other rows of elements not to be driven, with application of voltage 0 [V] to all of the electrodes $E_{m1}$ to $E_{ml}$. Naturally, the elements can be scanned, row by row, sequentially.

Such a multi-electron beam source in combination with grid electrodes orthogonal to the element rows enables construction of an XY matrix type electron beam source, and is promising for use for display apparatuses such as a flat plate type CRT.

The multi-electron beam source shown in FIG. 12, however, when driven by an electric circuit, causes occurrence of application of undesired spike-like voltage to element rows which should be halting. This problem is explained by reference to FIG. 13 and FIG. 14.

FIG. 13 shows a typical example of the electric circuits for driving the multi-electron beam source of FIG. 12. In FIG. 13, switching elements such as field effect transistor (FET) are connected in a manner of a totem pole to the distributing electrodes represented by $E_{p1}$ to $E_{pl}$. By suitably controlling gate signals GP1 to GPl and GN1 to GNl, for the respective rows of FET, 0 [V] (ground level) or $V_E$ [V] may be selectively applied to each wiring electrode. To the respective electrodes $E_{m1}$ to $E_{ml}$, voltage 0 [V] (ground level) is applied.

FIG. 14 exemplifies the voltages to be applied to each part for driving the multi-electron beam source with the electric circuit shown in FIG. 13. In FIG. 14, a case is considered in which the element rows are sequentially driven from the first row with interposition of halting periods as shown by FIG. 14 ①. (A multi-electron beam source for a flat plate type CRT, etc. is driven generally in such a driving method.)

In such a driving method, rectangular voltage pulses of $V_E$ [V] are applied to the wiring electrode $E_{p1}$ to $E_{p3}$ at timings shown in ② to ④ of FIG. 14, while voltage 0 [V] is applied to the wiring electrodes $E_{m1}$ to $E_{ml}$ as shown in ⑤ of FIG. 14. For example, the difference in the voltage between ② and ⑤ in FIG. 14 is applied to the first-row electron-emitting elements, whereby $V_E$ [V] is applied thereto during the time only of driving of the first row element as shown in ① of FIG. 14. In a similar manner, the difference in voltage of between ③ and ⑤ in FIG. 14 is applied to the second-row electron-emitting elements, and the difference in voltage between ④ and ⑤ in FIG. 14 is applied to the third-row electron-emitting elements.

However, according to actual observation with an oscilloscope, as shown by the folded lines ⑥ to ⑧ in FIG. 14, a spike-like voltage SP was found to be applied at the instant when another row of the elements is turned on or off.

The occurrence of the spike-like voltage SP is considered to result from instantaneous malfunction of FET caused by electric noise, electrical induction by mutual induction between adjacent wiring electrodes, deformation of applied voltage wave form by inductance, capacitance, resistance, etc. of the wiring electrodes before the voltage reaches the electron-emitting elements, and so forth.

If the amplitude of the spike-like voltage is relatively large, an electron beam is emitted from the electron-emitting element at an undesired point of time. This causes unwanted light emission which is irrelevant to the image to be displayed on a flat plate type CRT display, giving noise of the image or low contrast of the image, disadvantageously.

The description above explains the problems involved in the multi-electron beam source shown in FIG. 12. The problems involved in the multi-electron beam source shown in FIG. 18 are explained below.

In FIG. 18, ES denotes an electron-emitting element, $E_{c1}$ to $E_{CM}$ denote wiring electrodes in the column direction, and $E_{R1}$ to $E_{RN}$ denote wiring electrodes in the row direction. In this multi-electron beam source, electron-emitting elements of M×N in number are arranged in a matrix, and the elements are connected electrically by the column-direction wiring electrodes and the row-direction wiring electrodes to form a wiring matrix. The element groups arranged in parallel to the X direction are called element columns, and the element groups arranged in parallel to the Y direction are called element rows. Thus the element matrix is constructed from M element columns and N element rows.

Such a multi-electron beam source is generally driven, column by column, sequentially and selectively. Being different from the cases shown in FIG. 1 and FIG. 12, the ones of FIG. 18 are capable of emitting electron beams from desired electron-emitting elements selectively in the selected element columns. This is explained by reference to FIG. 19 to FIG. 22.

FIG. 19 is a graph showing a general characteristic of a cold cathode element used as an electron-emitting element ES, in which the abscissa shows the voltage applied to the element and the ordinate shows intensity of the electron beam emitted from the element. Generally, no electron beam is emitted from the element at an applied voltage lower than a certain threshold voltage $V_{th}$, and at the voltage exceeding the threshold voltage $V_{th}$, the intensity of the emitted electron beam increases with the increase of the applied voltage. Accordingly, a voltage $V_E$ can readily be set such that no electron beam is emitted at the voltage $V_E/2$ and an electron beam is emitted at the voltage $V_E$. A driving method utilizing such voltage $V_E$ is described below.

As an example, a case is considered in which the first element column is selected from the multi-electron beam source, and electron beams are allowed to be emitted from the second to fifth rows of the selected column. FIG. 20 shows the voltage application to the respective wiring electrodes for this purpose. Among the column-direction wiring electrodes $E_{C1}$ to $E_{C6}$, the voltage 0 [V] is applied to the first column wiring electrode $E_{C1}$, and the voltage $V_E/2$ [V] is applied to other electrodes $E_{C2}$ to $E_{C6}$. Among the row-direction wiring electrodes $E_{R1}$ to $E_{R6}$, the voltage $V_E$ [V] is applied to the second to fifth row electrodes $E_{R2}$ to $E_{R5}$, and the voltage $V_E/2$ is applied to $E_{R1}$ and $E_{R6}$. The voltage applied to each of the respective electron-emitting elements is the difference in voltage between the column-direction wiring electrode and the row-direction wiring electrode connected thereto. Therefore, $V_E$ [V] is applied to the solid-marked electron-emitting elements; $V_E/2$ [V] is applied to the obliquely striped or laterally striped electron-emitting elements; and 0 [V] is applied to the dot-marked electron-emitting elements in FIG. 20. Therefore, the voltage higher than the threshold for electron emission is applied to the intended electron-emitting elements to emit electron beams, whereas no electron beam is emitted from other electron-emitting elements.

As described above by reference to examples, the element columns can be selected by applying 0 [V] to the column-direction wiring electrode of the column of the element to be driven and applying $V_E/2$ [V] to other column-direction wiring electrode. Further, the intention can be achieved by applying $V_E$ [V] to the row-direction wiring electrode for the row to allow electron beam emission and applying $V_E/2$ [V] to the wiring electrodes for the rows to allow no electron beam emission. In the above-described driving method, the voltage applied to the row-direction wiring electrode to electron beam emission is fixed to $V_E$ [V], thereby intensity of the emitted electron beam is also fixed to a definite value $I_1$. The intensity of the emitted electron beam can be controlled in the range of from 0 to $I_1$ by selecting the applied voltage in the range of from $V_{th}$ [V] to $V_E$ [V] in accordance with the electron-emitting characteristic of the element as shown in FIG. 19.

Such a multi-electron beam source constitutes by itself an XY matrix type electron beam source, which is promising for the uses of display apparatus such as a flat plate type CRT.

However, in practical driving of a multi-electron beam source of FIG. 18 with an electric circuit, spike-like voltage is found to be caused and applied to the electron-emitting element. FIG. 21 to FIG. 23 are drawings for explaining such problems.

FIG. 21 shows a typical example of the electric circuits for driving the multi-electron beam source of FIG. 18. In FIG. 21, switching elements such as field effect transistor (FET) are connected in a manner of a totem pole to the wiring electrodes. The circuit connected to the column-direction wiring electrodes $E_{C1}$ to $E_{CM}$ applies 0 [V] or $V_E/2$ [V] selectively thereto, and the circuit connected to the row-direction wiring electrodes $E_{R1}$ to $E_{RN}$ applies $V_E$ [V] or $V_E/2$ [V] selectively thereto. The desired voltage can be selectively applied to the respective wiring electrodes by suitably controlling gate signals $GP_{C1}$ to $GP_{CM}$, $GN_{C1}$ to $GN_{CM}$, $GP_{R1}$ to $GP_{RN}$, and $GN_{R1}$ to $GN_{RN}$.

FIG. 22 is a drawing for explaining an example of an arbitrary driving pattern of the multi-electron beam source. The driving pattern is explained for the case where electron beams are emitted from the multi-electron beam source in a pattern of the letter "E" as shown by shadowing in FIG. 22. Generally a multi-electron beam source is driven such that element columns are driven sequentially, column by column, in the order of first column, the second column, the third column, and so forth. In such a manner, the "E" type pattern of FIG. 22 is completed. In FIG. 23, ① shows the change of driving steps with time.

For driving the element columns, the voltage is applied to the respective wiring electrodes as described above. For example, the first column elements are driven by application of driving voltage to the wiring electrodes in the same manner as described in the explanation of the driving procedure for FIG. 21. In FIG. 23, ② to ⑨ show the change with time of the voltages applied to wiring electrodes $E_{C1}$ to $E_{C4}$, and $E_{R1}$ to $E_{R4}$.

In driving of the electron beam source with the electric circuit shown in FIG. 21 according to the above procedure, occurrence of unwanted spike-like voltage was observed in the voltage applied practically to respective electron-emitting elements by an oscilloscope. For example, in the three elements denoted by A, B, and C in FIG. 21, the observed waveforms of the applied voltage were as shown by ⑩ to ⑫ in FIG. 23. In FIG. 23, SP(n) and SP(T) denote the unintended spike-like voltages.

The occurrence of the spike-like voltage SP(n) is considered to result from instantaneous malfunction of FET caused by electric noise, electrical induction by mutual inductance between adjacent wiring electrodes, deformation of applied voltage waveform by inductance, capacitance, resistance, etc. of the wiring electrodes before the voltage reaches the electron-emitting elements, and so forth. The main cause of occurrence of SP(T) is considered to be due to a time lag of the operation of FET for driving the column-direction wiring electrodes and the operation of the EFT for driving the row-direction wiring electrodes.

If the amplitude of the spike-like voltage is relatively high, an unwanted electron beam is emitted from the electron-emitting element at unintended time even though the emission occurs for a limited short time. This causes unwanted light emission which does not correspond to the image to be displayed on a flat plate type CRT display, giving noise of the image or low contrast of the image, disadvantageously.

SUMMARY OF THE INVENTION

The present invention intends to provide a multi-electron beam source and an image display device using the same in which the problems as described above are solved.

In accordance with the present invention, there is provided a multi-electron beam source comprising a plurality of electron-emitting elements provided two-dimensionally in a matrix-like arrangement on a substrate; wiring electrodes for wiring the electron-emitting elements in rows or in columns on the substrate, a driving circuit for driving the electron-emitting elements sequentially by rows or columns, and controlling electrodes for controlling penetration of electron beams emitted from the electron-emitting elements; the multi-electron beam source comprising further a means for cutting off the electron beam emitted from the electron-emitting elements caused by spike-like voltage superposed on driving signal generated by the driving circuit.

The above "wiring electrodes for dividing the electron-emitting elements on the substrate into groups" naturally include wiring electrodes of three types mentioned in the item of "Related Background Art", but are not limited thereto.

The above "controlling electrodes for controlling penetration of electron beams emitted from the multi-electron beam source" serve to cut off electron beams caused by the spike-like voltage from the electron-emitting elements. Any of other electrodes may be used as the controlling electrode provided that the electrode can perform this function. For example, a modulation electrode for modulating the current of the electron beam may be used as the controlling electrode, or otherwise focusing electrode for improving the focusing of the electron beam may be used therefor.

In accordance with the present invention, there is provided an excellent image displaying apparatus comprising the aforementioned multi-electron beam source, and a fluorescent screen which emits visible light by irradiation with an electron beam.

In accordance with the present invention, there is further provided a multi-electron beam source, and an image displaying apparatus described below.

In accordance with the present invention, there is provided a multi-electron beam source comprising an electron-emitting element part including: a plurality of electron-emitting elements provided two-dimensionally in a matrix-like arrangement on a substrate; opposing terminals of the electron-emitting elements arranged adjacently in the column direction thereof being electrically connected to each other; terminals on the same side of all the electron-emitting elements in the same row being electrically connected; and the plurality of electron-emitting elements being arranged in "m" rows, "m" representing a number of two or more; a driving circuit part for driving said electron-emitting element part; grid electrodes for modulating electron beams emitted from the electron-emitting elements; and means for cutting off the electron beams caused by spike noises superposed on driving pulse generated by the driving circuit part.

In accordance with the present invention, there is provided an image display device comprising the above multi-electron beam source, and a fluorescent material target for making an image visible by irradiation of an electron beam provided further thereabove.

The present invention provides a multi-electron beam source, comprising the above plurality of electron-emitting elements and an image display device employing the electron beam source, in which modulation grids are provided for modulating the electron beam emitted from the electron-emitting elements, and cutoff voltage is applied to the modulation grids to cut off the electron beam before or after the transition from ON to OFF or from OFF to ON of the switching elements connected to the aforementioned electron-emitting elements, preferably for 100 ns or longer, before and after the transition, thereby preventing emergence of undesired electron beam and drop of image contrast or crosstalk caused by undesired application of the aforementioned spike-like voltage to the electron-emitting elements.

Still another multi-electron beam source provided by the present invention comprises L rows of electron-emitting elements, each row of the electron-emitting elements being electrically connected in parallel with two wiring electrodes; each of the 2L wiring electrodes for the L rows of electron-emitting elements being connected electrically to a driving circuit for application of a driving signal independently to each row of the electron-emitting elements; a modulation electrode for modulating the electron beam emitted from the electron-emitting element on application of a driving signal; and means for cutting off the electron beam emitted from the electron-emitting elements caused by spike-like voltage superposed on a driving signal generated by the driving circuit.

Still another image displaying apparatus of the present invention comprises the above multi-electron beam source and a fluorescent screen which emits visible light on irradiation with an electron beam.

The above multi-electron beam source and the image displaying apparatus employing the electron source comprises a switching element for switching over the voltage applied to the electron-emitting element row, a cutoff voltage being applied to the modulation electrode to cut off the electron beam for the time of from just before to just after the transition of the switching element from ON to OFF or OFF to ON (preferably a time of from at least 100 [ns] before to at least 100 [ns] after the transition), which prevents emergence of an undesired electron beam caused by a spike-like voltage applied to the electron-emitting element, and noise generation and lowering of the contrast of the displayed image resulting therefrom.

According to still another aspect of the present invention, there is provided a multi-electron beam source, comprising a plurality of electron-emitting elements arranged two-dimensionally in a matrix, each of the electron-emitting elements being electrically connected in a matrix by M column-direction wirings and N row-direction wirings, a driving circuit is electrically connected to each of the column-direction wirings and the row-direction wirings to apply a driving signal to each electron-emitting element; a focusing electrode for focusing the electron beam emitted from the electron-emitting element; and means for cutting off the electron beam emitted from the electron-emitting elements caused by spike-like voltage superposed on a driving signal generated by the driving circuit with the focusing electrode.

Still another image displaying apparatus of the present invention comprises the above multi-electron beam source and a fluorescent screen which emits visible light on irradiation with an electron beam.

The above multi-electron beam source and the image displaying apparatus employing the electron source comprises a switching element for switching over the voltage applied to the electron-emitting elements, a cutoff voltage being applied to the focusing electrode to cut off the electron beam for the time of from just before to just after the transition of the switching element from ON to OFF or OFF to ON (preferably during a time of from at least 100 [ns] before to at least 100 [ns] after the transition), which prevents emergence of an undesired electron beam caused by a spike-like voltage applied to the electron-emitting element, and noise generation and lowering of the contrast of the displayed image resulting therefrom.

DESCRIPTION OF THE PREFERRED EMBODIMENTS

The present invention is described below in detail by reference to specific embodiments.

Embodiment 1

Figures 4A, 4B:
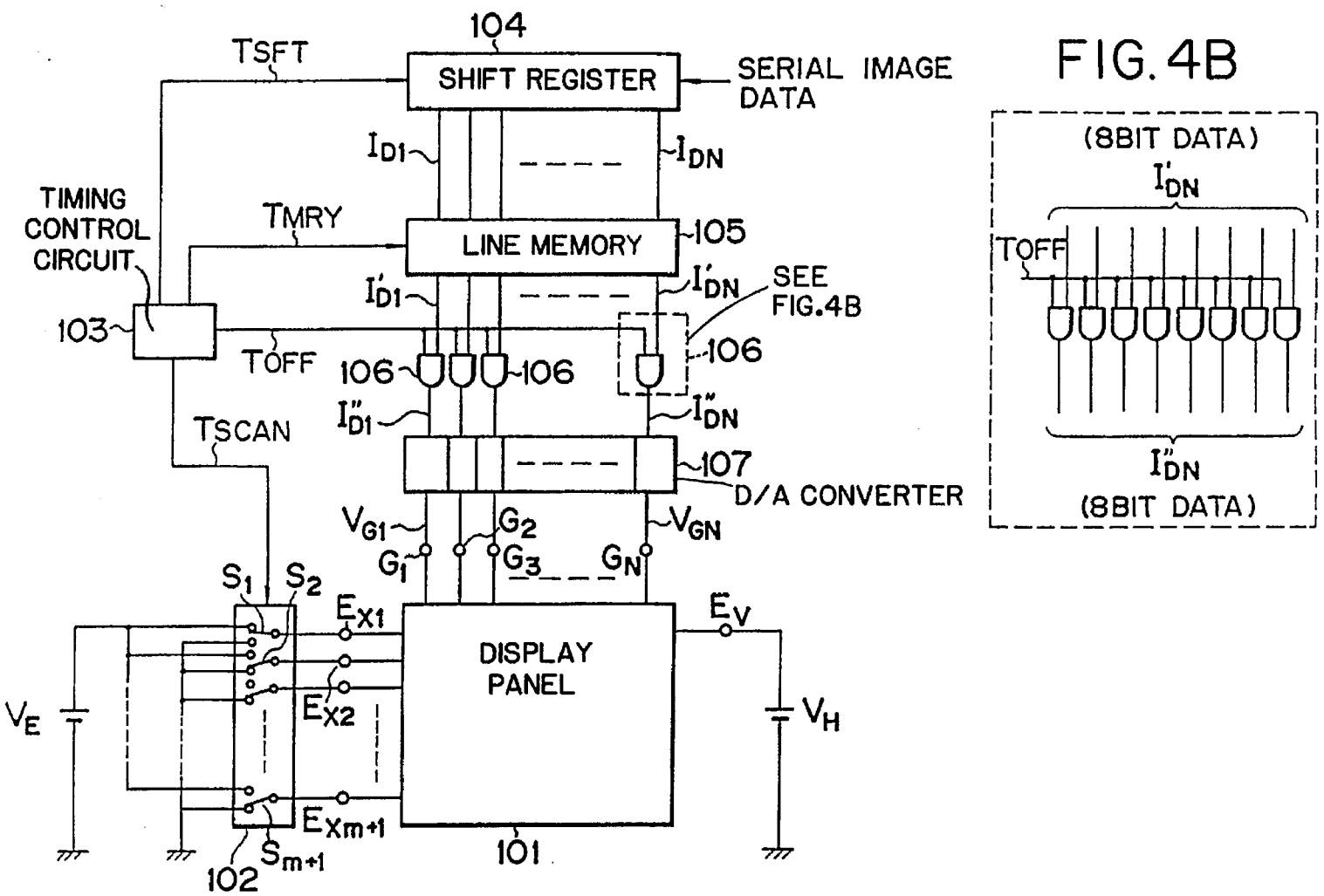
FIG. 4A is a simplified circuit diagram showing a basic constitution of embodiment 1 of the present invention and FIG. 4B is an enlarged view of a portion of FIG. 4A.

FIGS. 4A and 4B show an example of a circuit diagram of a flat panel type display apparatus of the present invention. In the diagram, the apparatus comprises a display panel 101, a switching element array 102, a timing control circuit 103, a shift register 104, a line memory 105, a gate array 106, and a D/A converter 107. The functions of the parts and the operation of the whole circuit are explained by reference to FIGS. 5A and 5B and FIG. 6.

Figures 5A, 5B:
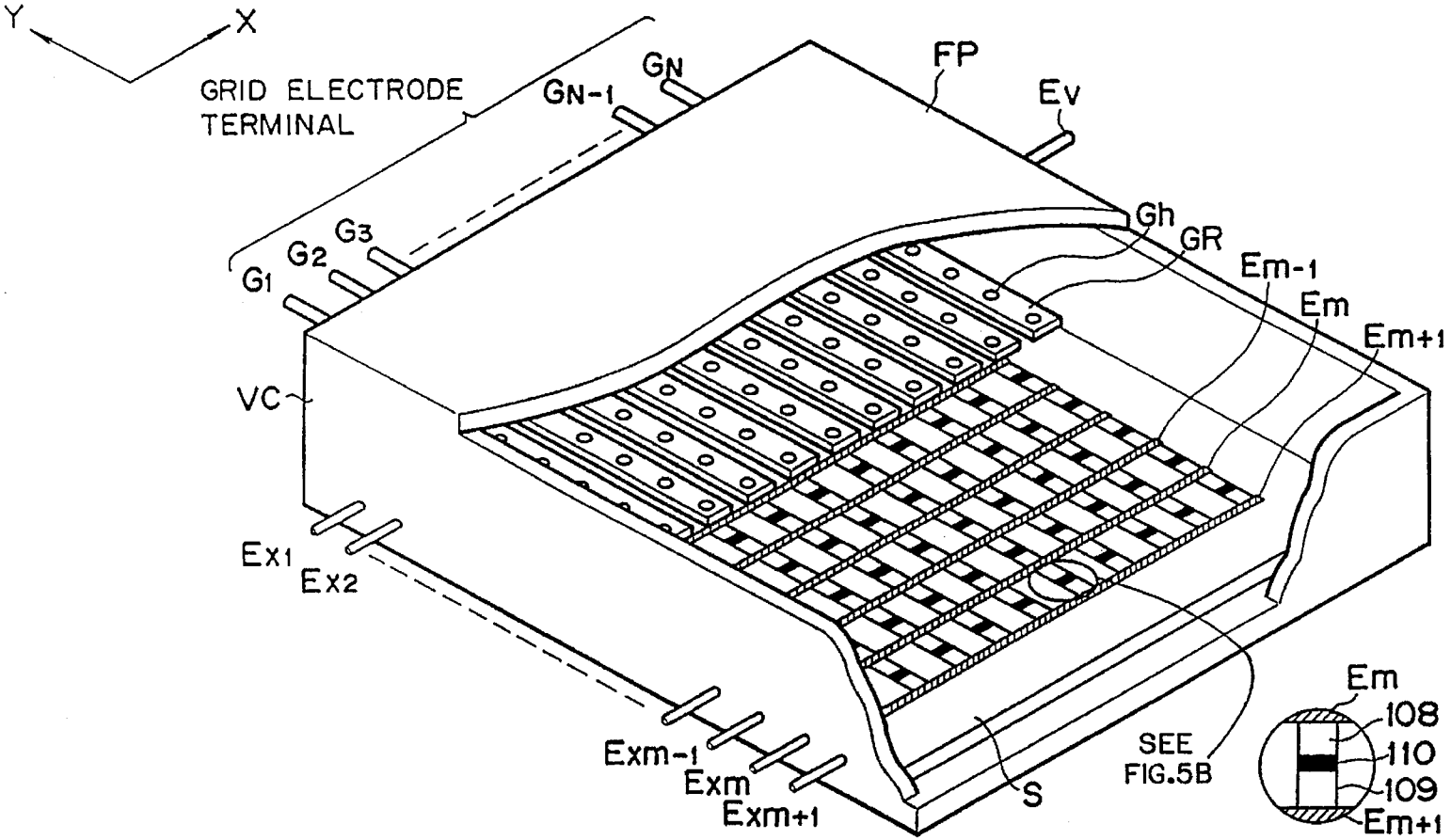
FIG. 5A is a partially cutaway perspective view of an example of a flat plate type display panel to which the present invention is applied and FIG. 5B is an enlarged view of a portion of FIG. 5A.

The display panel 101 is exemplified by a flat panel type CRT as shown by the partially cutaway perspective view in FIG. 5A, in which VC denotes a vacuum chamber made of glass and a portion FP is a face plate on the display face side. On the inside face of the face plate FP, a light-transmissive electrode made, for example, of ITO, and further thereon, fluorescent materials of red, green and blue are applied in a mosaic manner. The surface thereof is subjected to metal-back treatment which is known in the field of CRT. In the drawing, the light-transmissive electrode, the fluorescent material, and the metal-back are not shown. The light-transmissive electrode is electrically connected through a terminal EV to the outside for application of an accelerating voltage.

A glass substrate S is fixed at the bottom face of the vacuum chamber VC. On the substrate S, electron-emitting elements are formed in arrangement of N elements×l lines. The electron-emitting elements in each row are connected electrically in parallel by the wiring $E_1, E_2, E_3, \ldots$, or $E_{m+1}$. Each of the wiring $E_1, E_2, E_3, \ldots$, and $E_{m+1}$ is connected electrically through the terminals of $E_{x1}, E_{x2}, E_{x3}, \ldots$, or $E_{xm+1}$ to the outside of the vacuum chamber.

In FIG. 5B, the enlarged view in the circle shows an example of a surface conduction type electron-emitting element which comprises a positive electrode 108, a negative electrode 109, and an electron-emitting portion 110.

Between the substrate S and the face plate FP, grid electrodes GR in stripes are provided in N lines orthogonal to the aforementioned element rows. Each of the grid electrodes has through holes Gh for passing of electron beams. One through hole may be provided for each of the electron-emitting elements, or otherwise a number of fine holes are provided in a mesh state. Each of the grid electrodes are connected electrically through the terminal $G_1$ to $G_N$ to the outside of the vacuum chamber.

On this panel, an XY matrix is formed by m rows of electron-emitting elements and N lines of the grid electrodes. The electron emission rows are driven (or made to scan) one by one successively, and synchronously the modulation signal for one line of image is applied to the grid electrode lines, whereby projection of the respective electron beams to the fluorescent material is controlled, and the image is displayed by one line at a time.

In FIG. 4A, the terminal $E_v$ of the display panel 101 is connected to a high voltage source $V_H$ for application of accelerating voltage, e.g., 10[kV].

Figure 1:
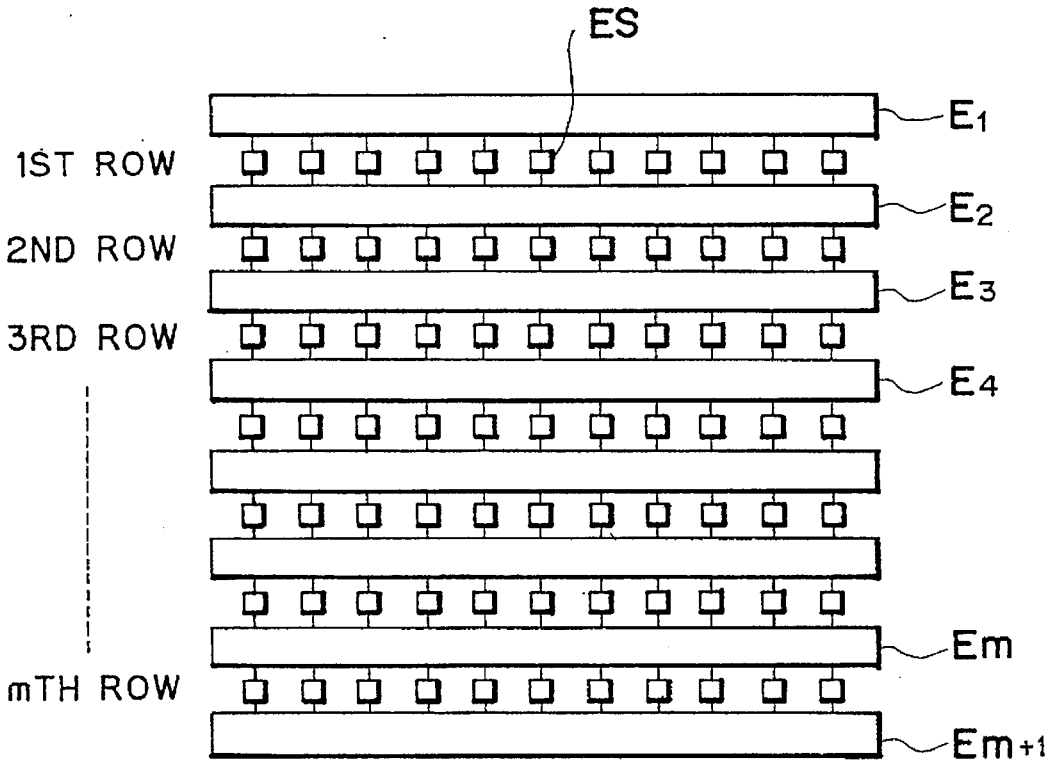
FIG. 1 shows the arrangement of electron-emitting elements of the multi-electron beam source to which the present invention is applied.
Figure 2:
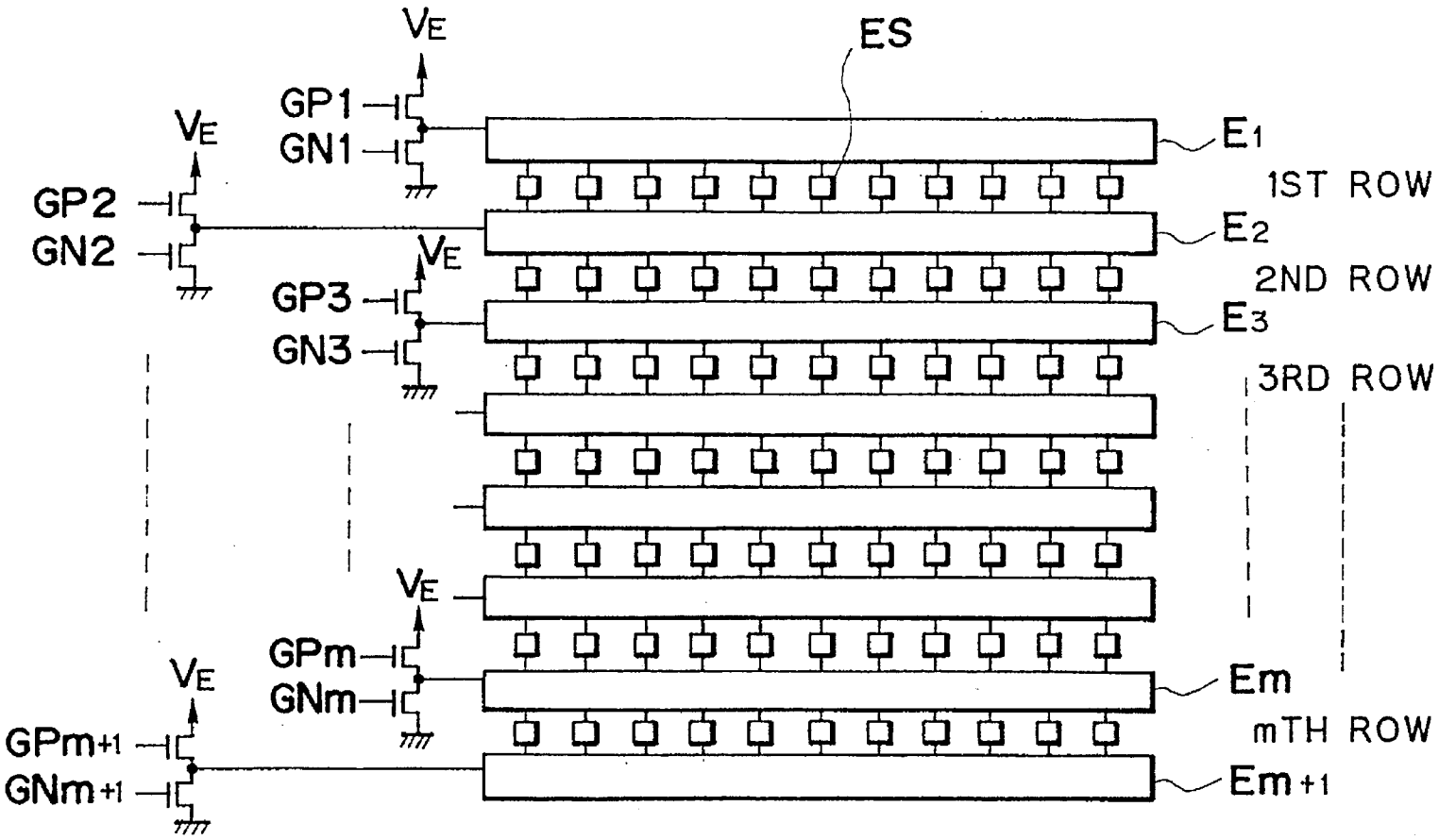
FIG. 2 shows an example of switching elements to be used in the electron source of FIG. 1.
Figure 3:
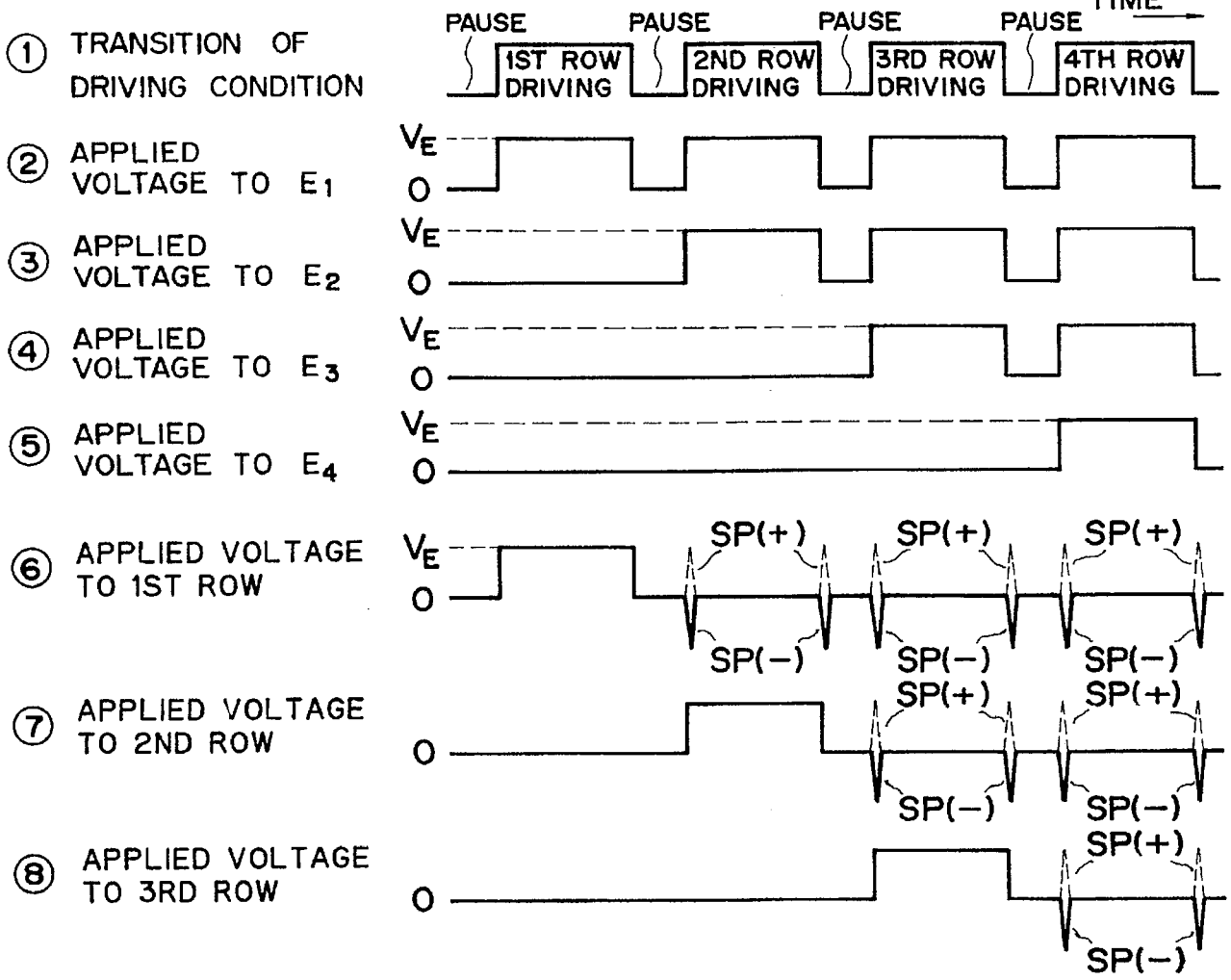
FIG. 3 is a time chart for explaining the problem caused by spike noises involved in conventional elements.

Each of the terminals $E_{x1}$ to $E_{xm+1}$ is connected respectively to the switching elements $S_1$ to $S_{m+1}$ of the switching element array 102, and the switching element functions to apply 0[V] (ground level) or a voltage, e.g., 14[V] or thereabout supplied from the power source $V_E$. Although the switching element $S_1$ to $S_{m+1}$ constituting the switching element array 102 is shown in FIG. 4 schematically, any type of switching elements may be employed provided that the element is capable of applying 0[V] or 14[V] selectively in accordance with the control signal for switching element array $T_{SCAN}$, e.g., an FET pair connected in a manner of a totem pole as shown in FIG. 2 as prior art.

The shift register 104 conducts serial-parallel conversion of serial image data transmitted from the outside in accordance with the shift clock signal $T_{SFT}$ generated by a timing control circuit 103. Since the panel in this embodiment has N picture elements for one line, the image data for the one line obtained by the serial-parallel conversion are outputted from the shift register 104 as N signals of $I_{D1}$ to $I_{DN}$.

Each of the image data of $I_{D1}$ to $I_{DN}$, if represented by 256 levels of gradation, is outputted as 8-bit binary data from the shift register. In FIG. 4, the signal line is denoted by a single line to simplify the drawing.

The line memory 105 latches one line of image data outputted from the shift register 104 in accordance with the memory load timing signal $T_{MRY}$ generated by the timing control circuit 103. In FIG. 4, the output signals from the line memory 105 are shown by symbols $I_{D1}$'0 to $I_{DN}$'. The gate array 106 computes the logical product of the image signal, $I_{D1}'$ to $I_{DN}'$, and the cutoff timing signal $T_{OFF}$ generated by the timing control circuit 103. In FIG. 4, the gate array portion connected to the signal line $I_{DN}'$ is shown in the detailed drawing surrounded by a dotted line. The signals of $I_{D1}'$ to $I_{DN-1}'$ are connected to an AND gates in the same manner to compute the logic product of the 8-bit image data and the control signal $T_{OFF}$.

The output signals $I_{D1}''$ to $I_{DN}''$ from the gate array 106 are inputted to N-membered D/A converters 107 and analog voltages $Y_{G1}$ to $V_{GN}$ are out put therefrom in correspondence with the image data, and are applied through the terminals $G_1$ to $G_N$ to the respective modulation grids.

The functions of the respective parts are explained above. Now, the operation of the entire device is explained by reference to the timing chart in FIG. 6.

Figure 6:
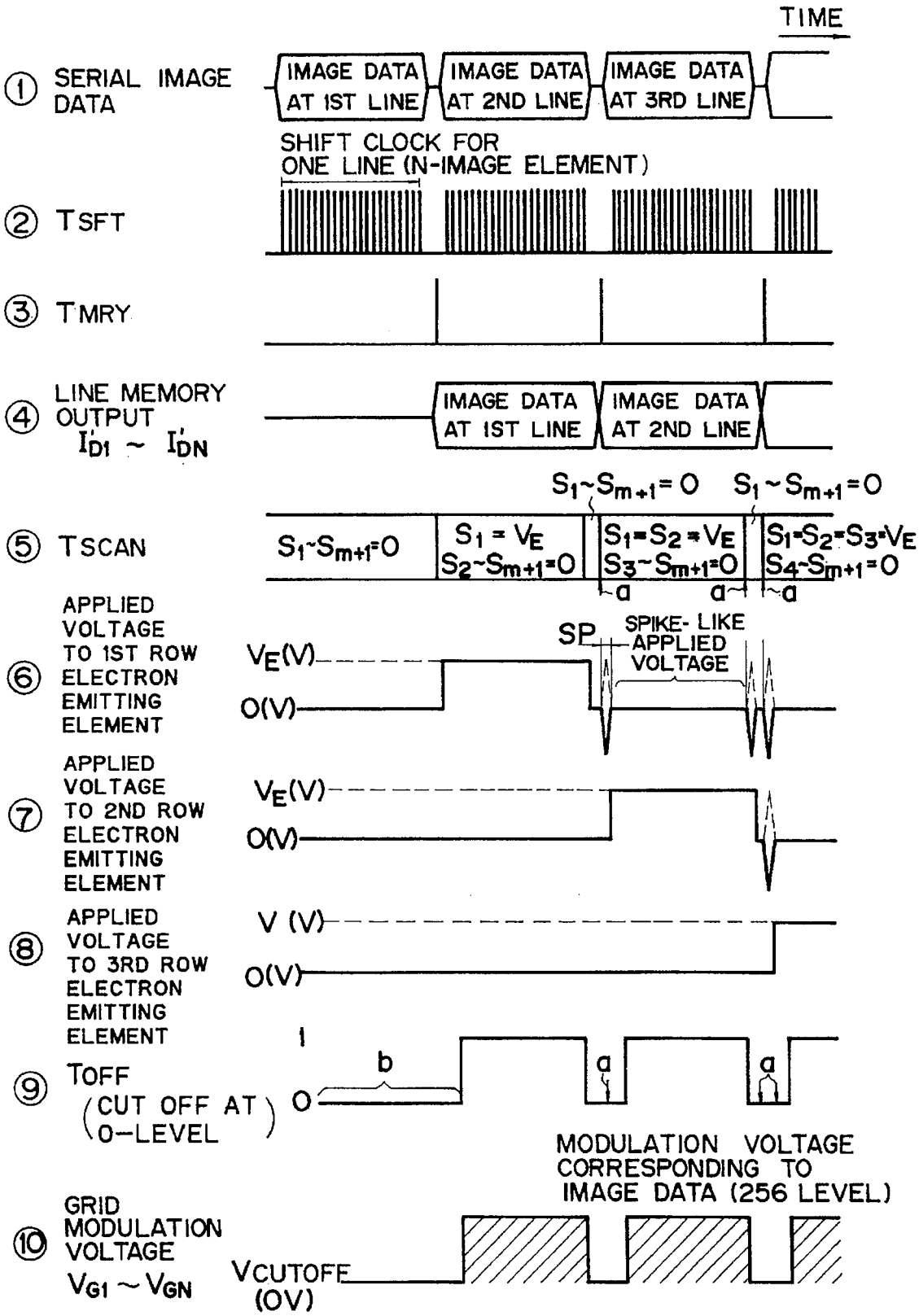
FIG. 6 is a timing chart for explaining the elementary operation in Embodiment 1.

In FIG. 6, ① shows serial image data to be inputted to the shift register 104 shown in FIG. 5. The serial image data are transmitted from an image information source (not shown in the drawing) successively in the line order: the first line data, the second line data, the third line data, and so forth (in picture element order within the line).

Synchronously with the above serial image data, shift clock signal $T_{SFT}$ as shown by ② in FIG. 6 is sent from the timing control circuit 103 to the shift register 104. Thus, when one line portion of the serial image data has been inputted, the shift register 104 completes the serial-parallel conversion for the line. In correspondence therewith, the timing circuit 103 generates a memory load timing signal $T_{MRY}$ to the one line memory 105, as shown at ③ of FIG. 6.

Therefore, the output $I_{D1}'$ to $I_{DN}'$ from the line memory 105 changes, in the order of the first line image data, the second line image data and so forth, synchronously with the above memory load timing signal $T_{MRY}$ as shown in ④ in FIG. 6.

On the other hand, the timing control circuit 103 gives control signals $T_{scan}$ and sends the signals to the switching element array 102, the content of the signals being shown in ⑤. In this drawing the indication, for example, "$S_1=V_E$" and "$S_2$~$S_{m+1}=0$", means that $V_E$[V] is applied to the switching element $S_1$, and 0[V] (ground level) is applied to each of the switching elements from $S_2$ to $S_{m+1}$ selectively.

Consequently, the driving voltage is successively applied to the respective electron-emitting element row as shown in ⑦, ⑧ and ⑨. In this step, as mentioned in the description on the problems in the related background art, spike-like application voltage will arise owing to variation in the characteristics of the switching elements $S_1$ to $S_{m+1}$.

Hereinafter the switching time of the switching element is represented by "$\tau_s$". Although the switching time $\tau_s$ varies for every switching element, it is feasible to control the maximum value of the $\tau_s$ to be less than a certain value. Practically commercial FET arrays and the like are specified by the maximum value of $\tau_s$ (herein after referred to as $\tau_{max}$).

The time width of the spike-like voltage (hereinafter represented by "SP") and $\tau_{max}$ are in the relation of $0<SP<\tau_{max}$. The time of occurrence of the spike-like voltage is known in advance. In ⑤ in FIG. 6, the spike beginning time is shown by an arrow mark a under the switching element control signal $T_{SCAN}$.

In the present invention, a cutoff potential $V_{cutoff}$ is applied to the modulation grid for at least 100[ns] before and after the occurrence of the spike-like voltage application to the electron-emitting element row in order to cut off the electron beam. In this embodiment, the cutoff is practiced by inputting an appropriate cutoff timing signal $T_{OFF}$ to the gate array 106 in FIG. 4.

In other words, when a zero level is inputted as $T_{OFF}$, the outputs of the gate arrays are all zero, which corresponds equivalently to black levels of the image data. During this time, the D/A converter 107 outputs $V_{cutoff}$ to cut off the electron beam.

The cutoff timing signal $T_{OFF}$ is illustrated in ⑨ in FIG. 6. In this drawing, the beginning of the spike-like voltage as mentioned regarding ⑤ is shown by the arrow mark a. $T_{OFF}$ is controlled to be at a zero level at least from the time 100[ns] before the arrow mark a to the time $\tau_{smax}$+100[ns] after the arrow mark a. In the drawing, $T_{OFF}$ is kept at a zero level during the time shown by b in order to keep the modulation grid at a cutoff state until the first line of the image data to be displayed has been set in the line memory 105, which does not directly relate to the object of the present invention, namely the prevention of undesired light emission caused by spike-like application voltage.

As described above, by inputting $T_{OFF}$ to the gate array 106, the output voltage, $V_{G1}$ to $V_{GN}$, of the D/A converter 107 is grid-modulating voltage shown in ⑩ in FIG. 6, where, in the shadowed portions, the levels differ depending on the grid and the line, and the electron beams emitted from the electron-emitting element rows are appropriately modulated to form an image. Thus the grids cut off the undesired electron beams caused by a spike-like applied voltage, which offsets completely the disadvantages of luminance contrast drop, and crosstalk.

In this embodiment, the cutoff timing $T_{OFF}$ is decided on the assumption that the gate array 106 and the D/A converter 107 act in sufficiently high speed. If the action thereof is slow, the cutoff timing needs to be advanced relative to the arrow mark a in ⑨ in FIG. 6 in accordance with the action time. The essential thing is that it is enough to be so constituted that the cutoff potential can be applied effectively to the grids for the duration of time when the spike-like voltage is applied to the electron-emitting elements. As a means to apply a cutoff potential to grids, a circuit combined with a semiconductor element such as FET is used actually, but the $\tau_{smax}$ of the circuit is about in the level of 100 ns practically.

Accordingly, it is enough to be so constituted that the cutoff potential can be applied to the grids, preferably, for at least the time of 100 ns before and after the period of time when the spike-like voltage is applied, in consideration of the $\tau_{max}$ above.

Embodiment 2

Figure 7:
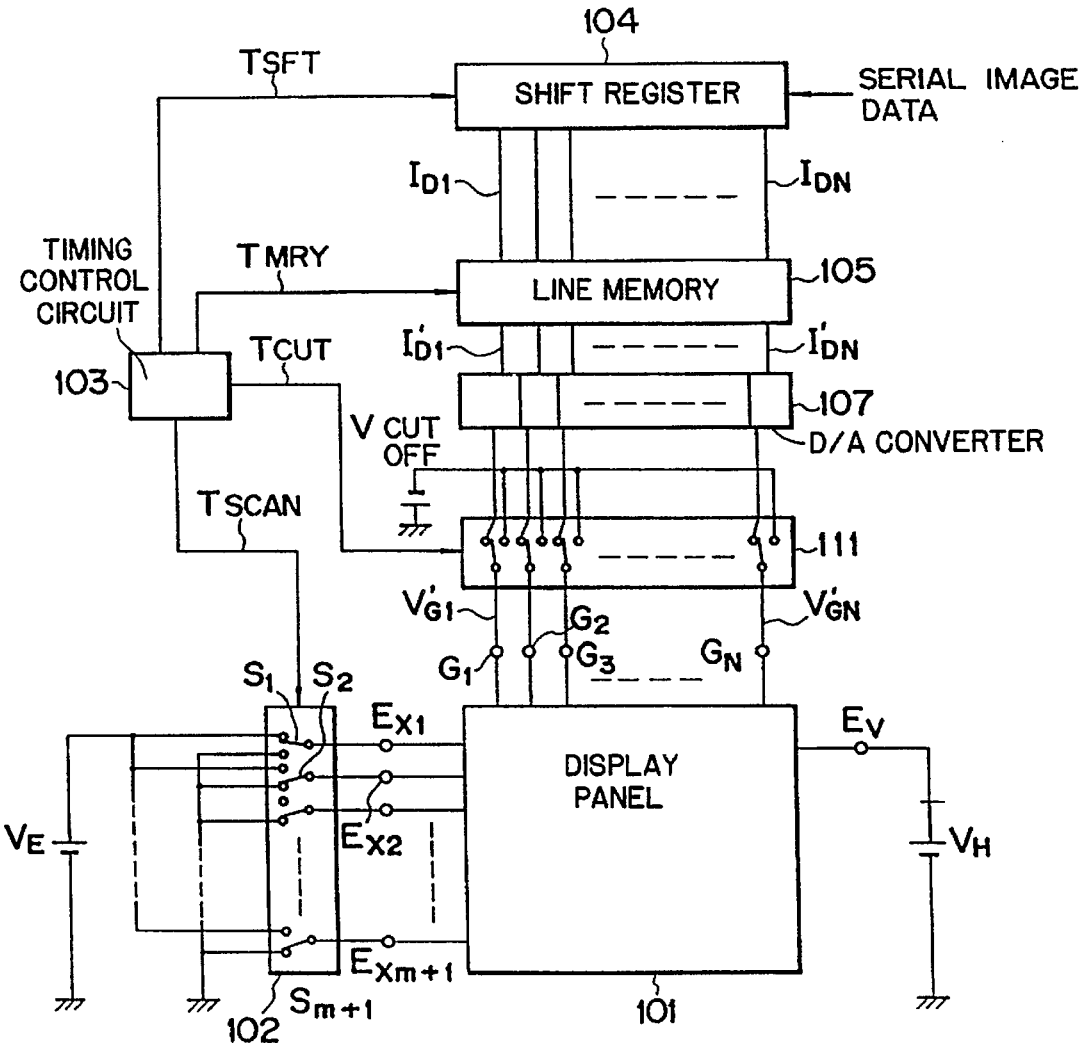
FIG. 7 is a simplified circuit diagram showing the basic constitution of Embodiment 2.

Embodiment 2 is explained by reference to FIG. 7.

Being different from Embodiment 1 where the gate array is provided between the line memory 105 and the D/A converter 107, the output signals $I_{D1}'$ to $I_{DN}'$ from the line memory 105, in this Embodiment, are directly inputted to the D/A converter 107. A switching element array 111 is provided between the D/A converter 107 and the display panel 101, and is operated according to the signal $T_{cut}$ given by the timing control circuit 103. The switching element array 111 has N switching elements. The switching element applies either the output voltage of the D/A converter 107 or the cutoff potential given by the voltage source $V_{cutoff}$ to the terminal $G_1$ to $G_N$ of the display panel. In this Embodiment, all the switching elements of the switching element array 111 are connected to the voltage source $V_{cutoff}$ for the time of 100[ns] or more before and after the spike-like voltage comes to be applied to the electron-emitting element, thereby the same effect as in the embodiment shown in FIG. 4A can be achieved.

The present invention is applicable not only to the flat plate CRT in FIG. 5A, but also applicable to any display panel which has multi-electron beam sources arranged in a form shown in FIG. 2 and modulation electrodes for modulating electron beams, such as a fluorescent display tube.

Embodiment 3

Figures 15A, 15B:
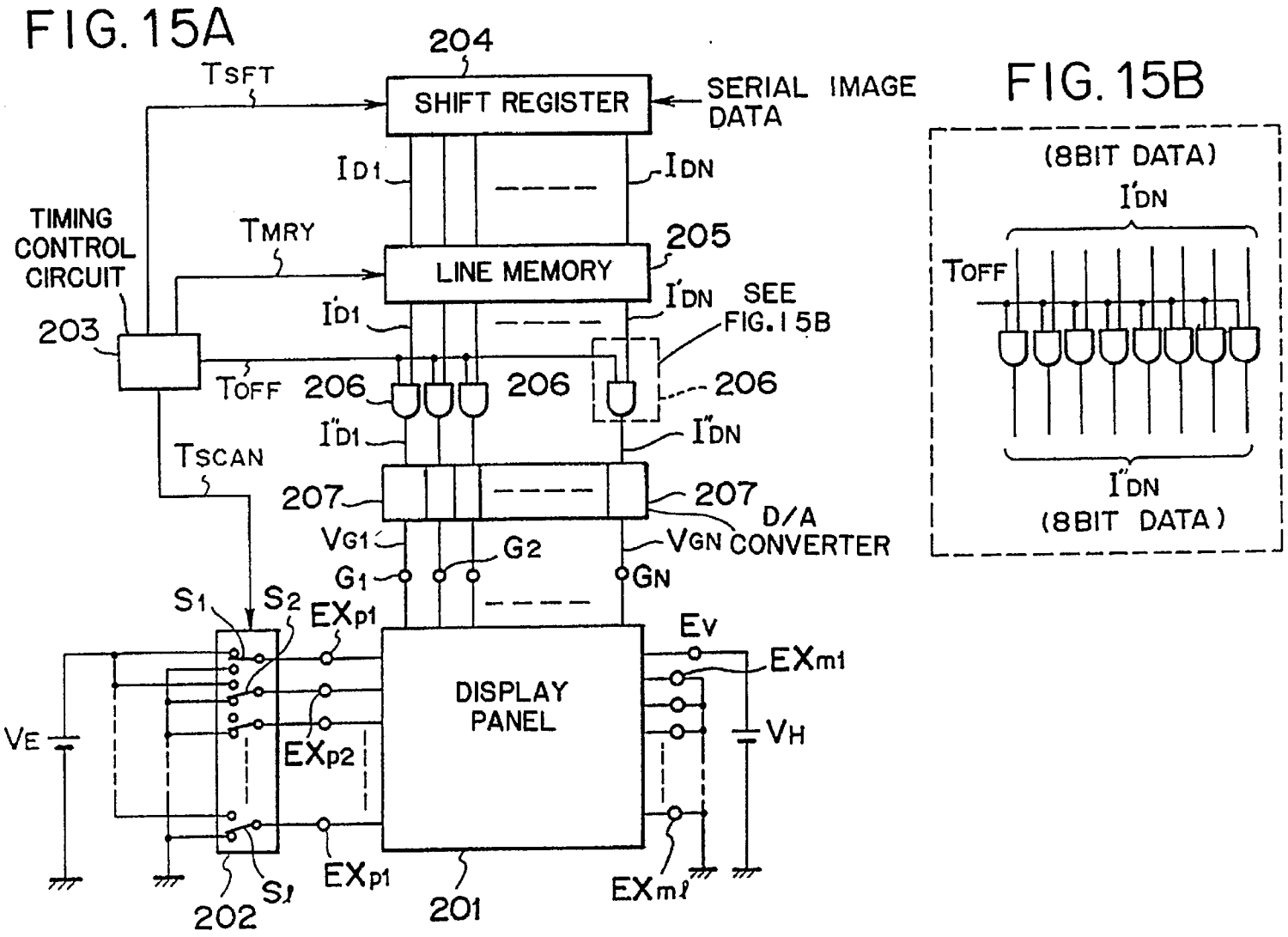
FIG. 15A is a simplified circuit diagram showing a basic constitution of Embodiment 3 of the present invention.
FIG. 15B is an enlarged view of a portion of FIG. 15A.

FIGS. 15A and 15B show a circuit construction of the flat plate type display apparatus of a third embodiment of the present invention. The apparatus comprises a display panel 201, a switching element array 202, a timing control circuit 203, a shift resistor 204, a one-line memory 205, Gate arrays 206, and D/A converters 207. The functions of the respective parts and the operation of the entire circuit are explained by reference to FIGS. 16A and 16B and FIG. 17.

Figures 16A, 16B:
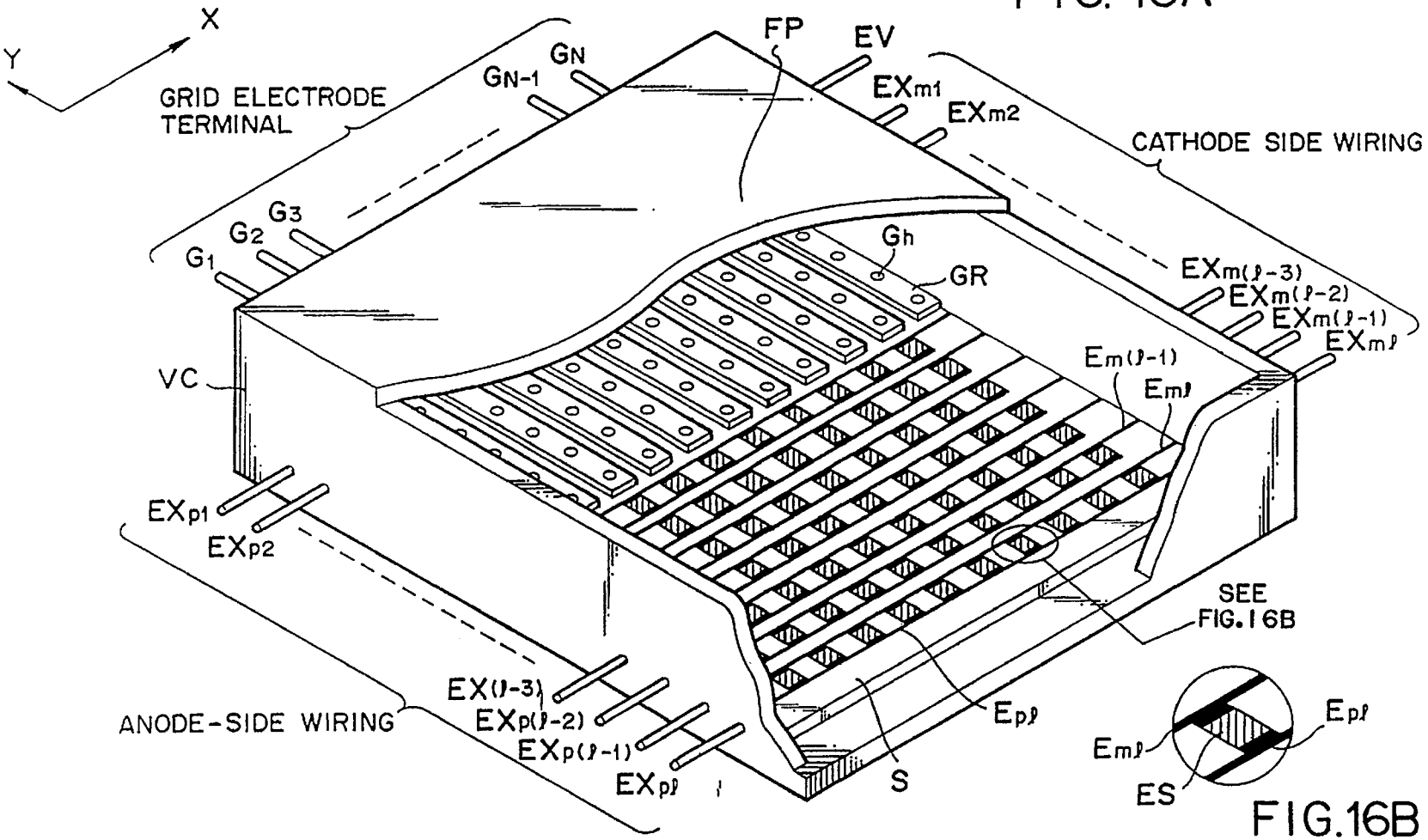
FIG. 16A is a partially cutaway perspective view of an example of a flat plate type display panel to which the present invention is applied.
FIG. 16B is an enlarged view of a portion of FIG. 16A.

The display panel 201, for example, is a flat plate type CRT like the one shown by a partially cutaway perspective view in FIG. 16A. In FIG. 16A, VC denotes a vacuum chamber made of glass, and FP, which is a portion of VC, denotes the face plate (or display screen) thereof. On the inside face of the face plate FP, a light-transmissive electrode is formed from a material like ITO, and further thereon, fluorescent materials of red, green, and blue are applied mosaically. The surface thereof is treated for metal back which is known in the field of CRT. (The light-transmissive electrode, the fluorescent materials, and the metal back are not shown in the drawing.) The vacuum chamber VC has an air-tight terminal EV, through which an accelerating voltage can be applied from a power source $V_H$ outside the vacuum chamber to the light-transmissive electrode and the metal back.

Figure 12:
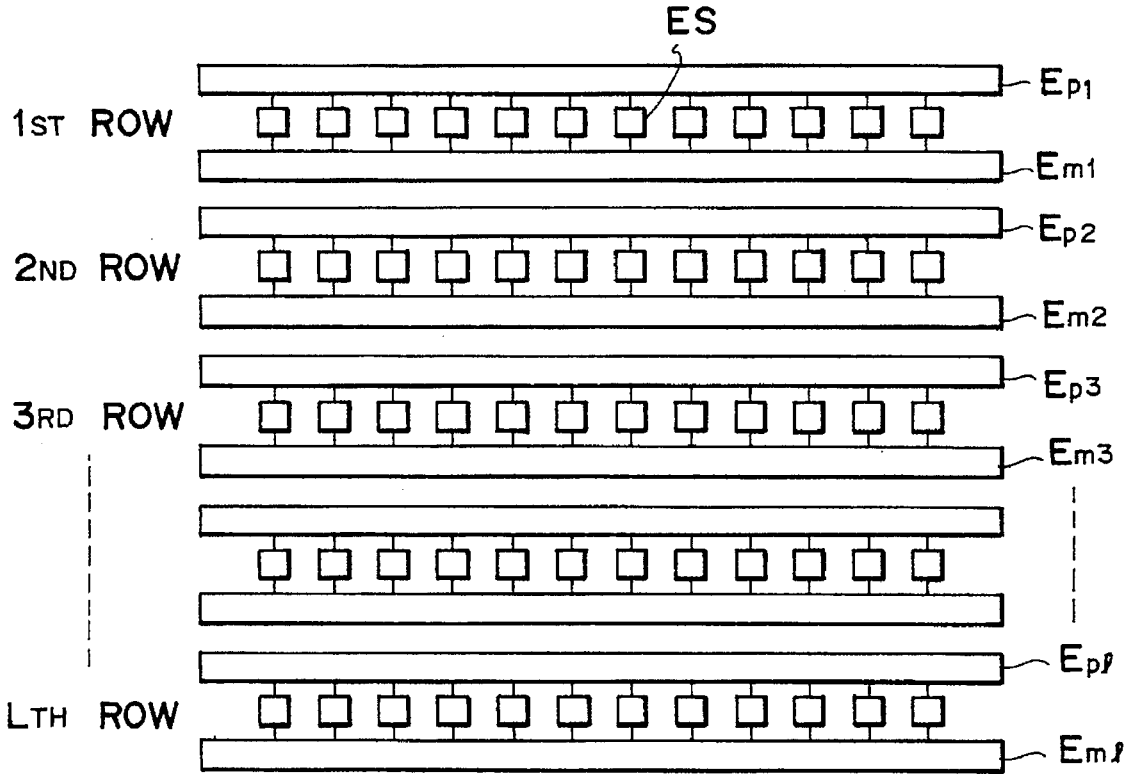
FIG. 12 shows the arrangement of electron-emitting elements in another multi-electron beam source to which the present invention is applied.

A glass substrate S is fixed to the bottom of the vacuum chamber VC. On the upper face of the glass substrate, N×L electron-emitting elements are formed as shown in FIG. 12. The electron-emitting elements in each row are connected electrically in parallel by wirings $E_{p1}$ to $E_{pl}$ and $E_{m1}$ to $E_{ml}$, and the wirings are connected electrically to the outside through the airtight terminals $EX_{p1}$ to $EX_{pl}$ and $EX_{m1}$ to $EX_{ml}$.

Between the substrate S and the face plate FP, grid electrodes GR are provided, N in number, in stripes. The grid electrodes GR are placed in a direction orthogonal to the rows of the electron-emitting elements (Y direction in FIG. 16). The grid electrodes have through holes Gh respectively for passing electron beams. One through-hole may be provided for each of the electron-emitting elements, or otherwise a number of fine through holes may be provided therefor. Each of the grid electrodes are connected electrically through the air-tight terminals $G_1$ to $G_N$ to the outside of the vacuum chamber.

In this display panel, an XY matrix is formed by L rows of the electron emitting elements and N columns of the grid electrodes. The electron-emitting electrode rows are driven (or scanned), row by row, sequentially, and synchronously the modulation signal for one line of image is applied to the N grid electrodes, whereby projection of the respective electron beams onto the fluorescent material is controlled, and the image is displayed by one line at a time.

In FIG. 15A, the terminal $E_V$ of the display panel 201 is connected to a high voltage source $V_H$ for application of accelerating voltage, e.g., 10 [KV].

Figure 13:
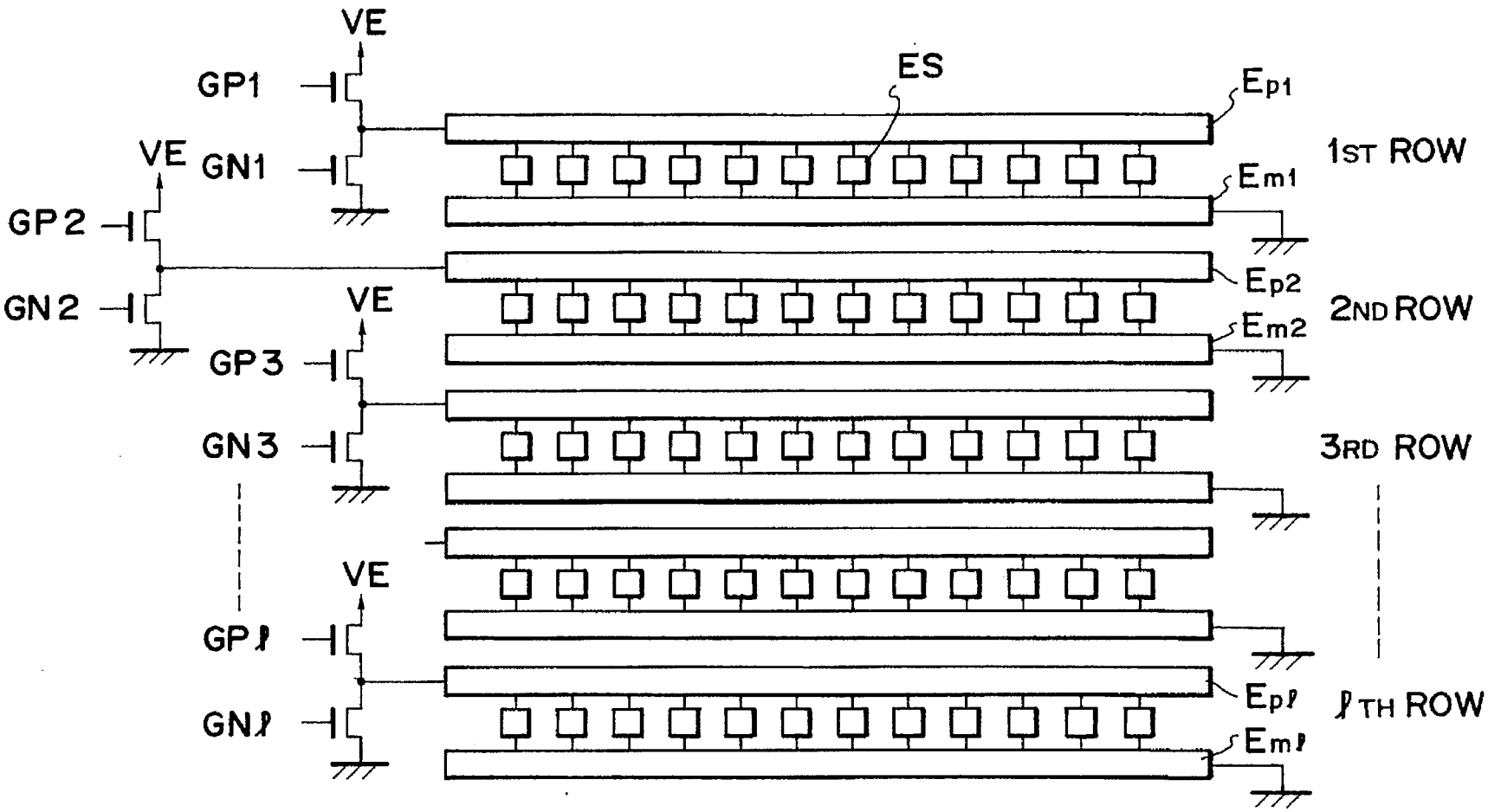
FIG. 13 shows an example of the driving circuit employed in the electron source of FIG. 12.
Figure 14:
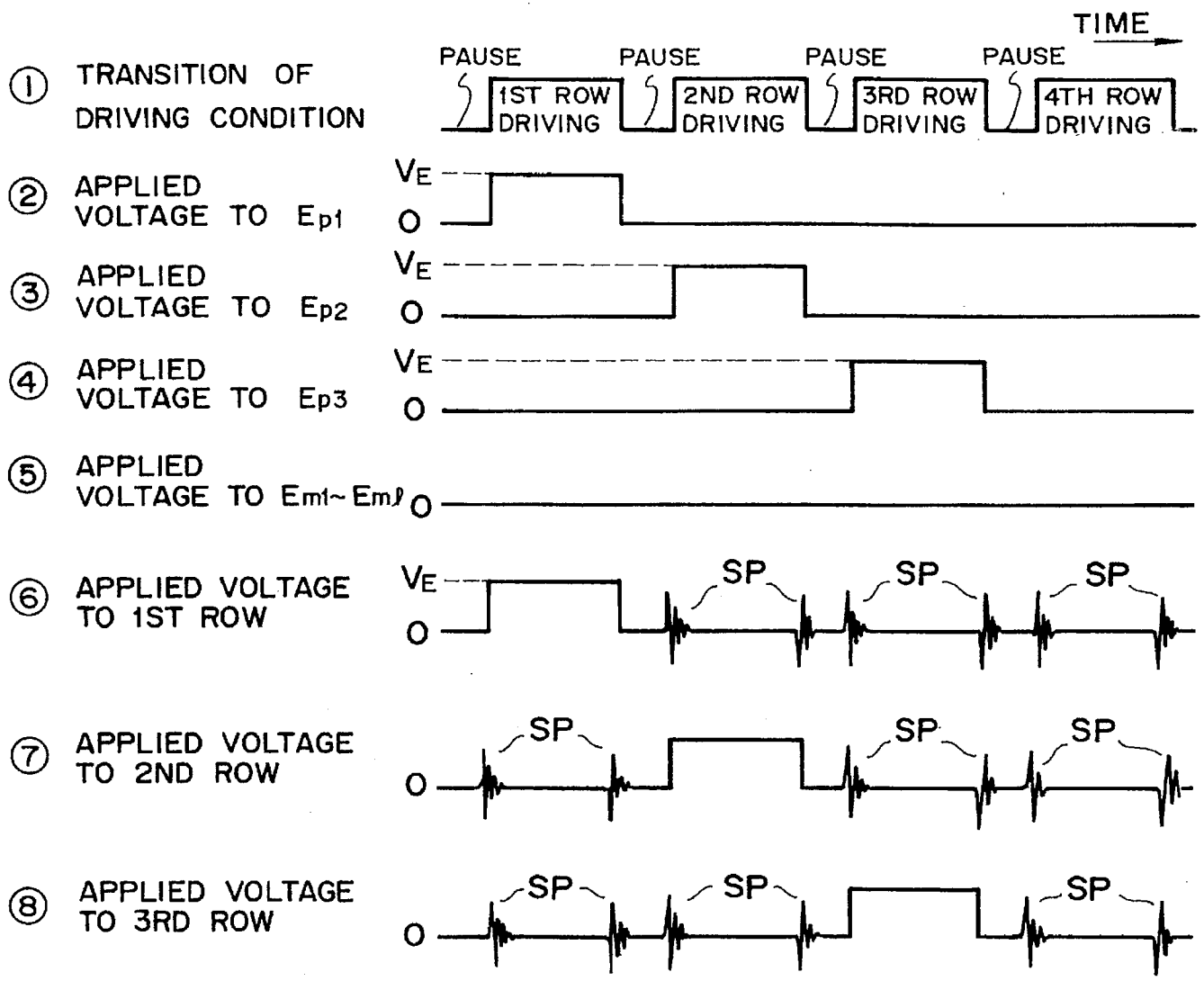
FIG. 14 is a time chart for explaining the problem caused by spike noises involved in conventional elements.

The terminals, $EX_{m1}$ to $EX_{ml}$, are connected electrically to the ground level (namely, 0 [V]). Each of the terminals, $EX_{p1}$ to $EX_{pl}$, is connected respectively to a switching element, $S_1$ to $S_l$, of the switching element array 202. The switching elements respectively function to apply the ground level (0 [V]) or the output voltage of the power source $V_E$ selectively. In FIG. 15A, the switching elements, $S_1$ to $S_l$, are shown schematically to constitute the switching element array 202. However, any type of switching element may be employed, provided that the element is capable of connecting ground level or power source $V_E$ selectively in accordance with control signals $T_{SCAN}$. For example, an FET pair may be used which is connected in a manner of a totem pole as shown in FIG. 13.

The shift register 204 conducts serial-parallel conversion of serial image data transmitted from the outside in accordance with the clock signal $T_{SFT}$ generated by a timing control circuit 203. Since the display panel in this embodiment has N picture elements for one line, the image data for the one line obtained by the serial-parallel conversion are outputted from the shift register 204 as N signals of $I_{D1}$ to $I_{DN}$. If each of the image data of $I_{D1}$ to $I_{DN}$ is given by 256 levels of gradation, it is outputted as 8-bit binary data from the shift register. In FIG. 15A, the signal lines are denoted by single lines to simplify the drawing.

The line memory 205 latches one line of the image data outputted from the shift register 204 in accordance with the memory load timing signal $T_{MRY}$ generated by the timing control circuit 203. In FIG. 15A, the output signals from the line memory 205 are shown by symbols $I'_{D1}$ to $I'_{DN}$.

The gate array 206 computes the logical product of the image signal, $I'_{D1}$ to $I'_{DN}$, and the cutoff timing signal, $T_{OFF}$, generated by the timing control circuit 203. In FIG. 15B, the gate array portion connected to the signal line $I'_{DN}$ is shown in the detailed drawing surrounded by a dotted line. Other gate arrays have the same constitution. They are connected to AND gates to compute the logic product of the 8-bit image data and the control signal $T_{OFF}$.

The output signals, $I''_{D1}$ to $I''_{DN}$, from the gate array 206 are inputted to the N-membered D/A converters 207, and converted to analog voltage signals, $V_{G1}$ to $V_{GN}$. The signals are outputted therefrom in correspondence with the image data, and are applied through the terminals $G_1$ to $G_N$ to the respective modulation grids of the display panel 201.

The functions of the respective parts are explained above. Next, the operation of the entire device is explained by reference to the timing chart in FIG. 17.

Figure 17:
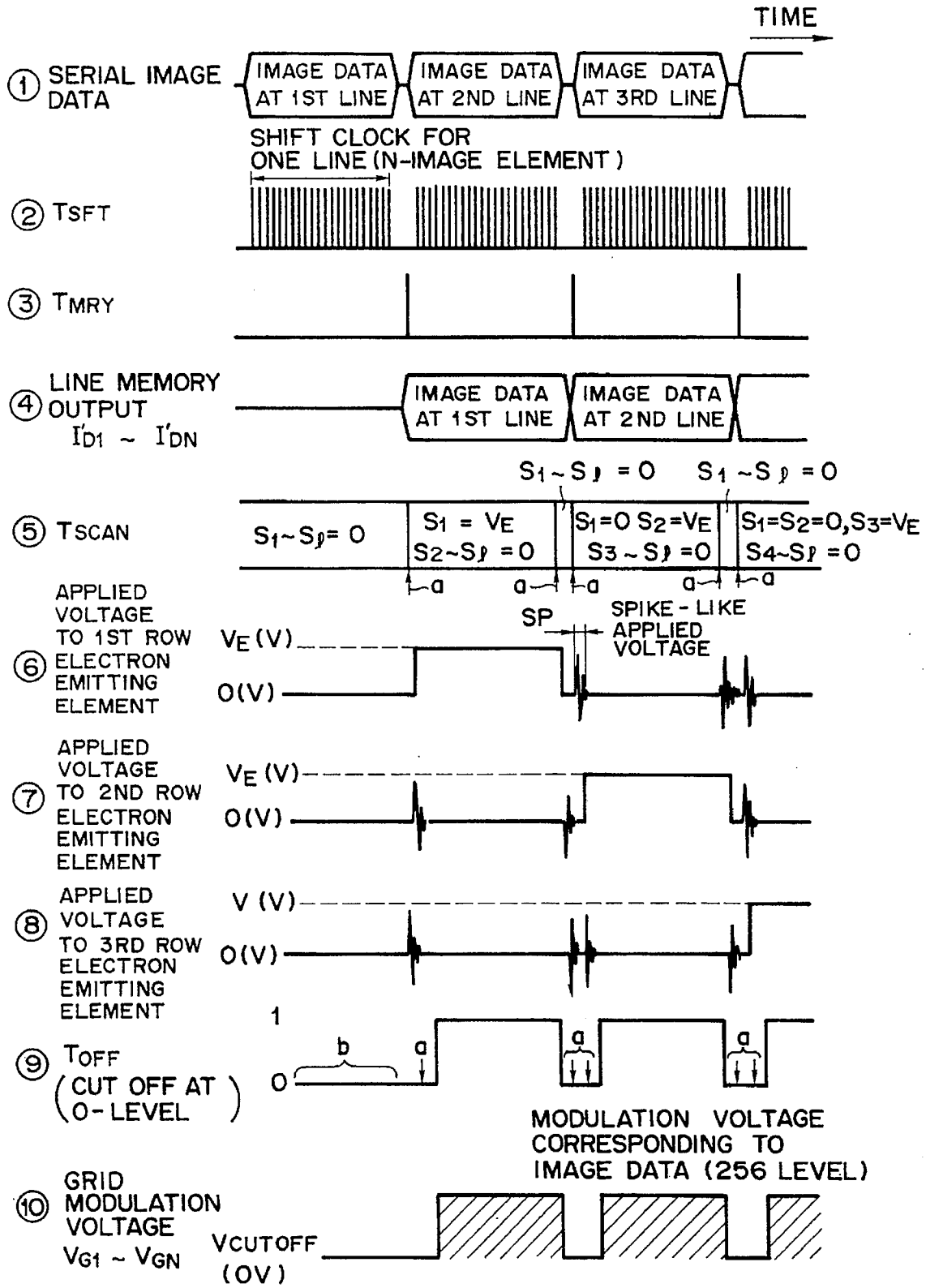
FIG. 17 is a time chart for explaining the operation in example of FIG. 15.

In FIG. 17, ① shows serial image data to be inputted to the shift register 204 shown in FIG. 15A. The serial image data are transmitted from an image information source (not shown in the drawing) successively in the line order: the first line data, the second line data, the third line data, and so forth (in the picture element order sequentially within the line).

Synchronously with the above serial image data, a shift clock signal $T_{SFT}$ as shown by ② in FIG. 17 is sent from the timing control circuit 203 to the shift register 204. The shift register 204 conducts the serial-parallel conversion for the one line in accordance with the shift clock signal $T_{SFT}$. Synchronously with the completion of serial-parallel conversion, the timing control circuit 203 generates a memory load timing signal $T_{MRY}$ to the one line memory 205, as shown by ③ in FIG. 17. Therefore, the output from the line memory 205 changes, in the order of the first line image data, the second line image data, and so forth, synchronously with the above memory load timing signal $T_{MRY}$ as shown by ④ in FIG. 17.

On the other hand, the timing control circuit 203 generates control signals $T_{SCAN}$ and sends the signals to the switching element array 202 to drive the electron-emitting element row to be displayed at an appropriate timing. The contents of the signals are shown by ⑤ in FIG. 17. In this drawing, for example, the indication of "$S_1=V_E$" and "$S_2$~$S_l$=0" means that $V_E$ [V] is selected by the switching element $S_1$, and 0[V] is selected by each of the switching elements of $S_2$ to $S_l$.

As the result of such operation of the switching elements, wave form voltages as illustrated by ⑥, ⑦, and ⑧ in FIG. 17 are applied to each of the electron-emitting element rows. The applied voltages are accompanied with the spike-like voltage SP as mentioned in the description of "Related Background Art". The spike-like voltage SP is generated synchronously with the instant when the switching element in the switching array 202 is switched over (at the time shown by the arrow mark a in ⑤ of FIG. 17). The time of duration of the spike-like voltage depends on the variation in the working speed of the switching element, and the electric circuit constant of the circuit from the switching element to the electron-emitting element row. In the present invention, control is made to apply a cutoff potential $V_{CUTOFF}$ to the modulation grid to cut off the electron beam during the period in which the spike-like voltage is being applied to the electron-emitting element row. Preferably, the cutoff potential $V_{CUTOFF}$ is applied for a period of from at least 100 [ns] before to at least 100 [ns] after the occurrence of application of the spike-like voltage to the electron-emitting element row. In this embodiment, the control is conducted by inputting an appropriate cutoff timing signal $T_{OFF}$ to the gate array 206 in FIG. 15.

At the zero level of $T_{OFF}$, the output of the gate array 206 comes to be zero, which is equivalent to the conversion of the image data to a black level, and during that time the D/A converter 207 outputs the potential $V_{CUTOFF}$ to cut off the electron beam.

In FIG. 17, ⑨ shows an example of the cutoff timing signal $T_{OFF}$ with denotation of the initiation point (arrow mark a) of the spike-like voltage shown by ⑤ in FIG. 17 above. $T_{OFF}$ is controlled to be at a zero level at least for the time of from 100 [ns] before the arrow mark to SP+100 [ns] after the arrow mark a. During the period denoted by b in ⑨ of FIG. 17, $T_{OFF}$ is controlled to be at a zero level for the purpose of keeping the modulation grid in a cutoff state until the image data for the first line to be displayed has been set to the line memory 205.

As the result of inputting the aforementioned cutoff timing signal $T_{OFF}$ to the gate array 206, the D/A converter 207 outputs grid modulation voltages, $V_{G1}$ to $V_{GN}$, as shown by ⑩ in FIG. 17. In ⑩ of FIG. 17, the level of the shadowed portion varies for each grid for each line, whereby the electron-emitting element rows emit electron beams with appropriate modulation to form an image. In the emission of the electron beam, an undesired electron beam caused by spike-like voltage application is cut off by the modulation grid and does not reach the fluorescent screen. Accordingly, the problems of high noise and low contrast of the image are completely solved.

In this embodiment, the gate array 206 and the D/A converter 207 work at sufficient high speed, so that the cutoff timing $T_{OFF}$ is decided without adjustment for the signal delay resulting from the working speed. If the working speed is low, the cutoff timing needs to be advanced in correspondence with the working time relative to the arrow mark a in ⑨ of FIG. 17. In short, the electron source is required essentially to be constructed such that the cutoff potential is applied to the modulation grid effectively for the time of from at least 100 [ns] before to at least 100 [ns] after the period where the spike-like voltage is being applied.

Embodiment 4

Figure 24:
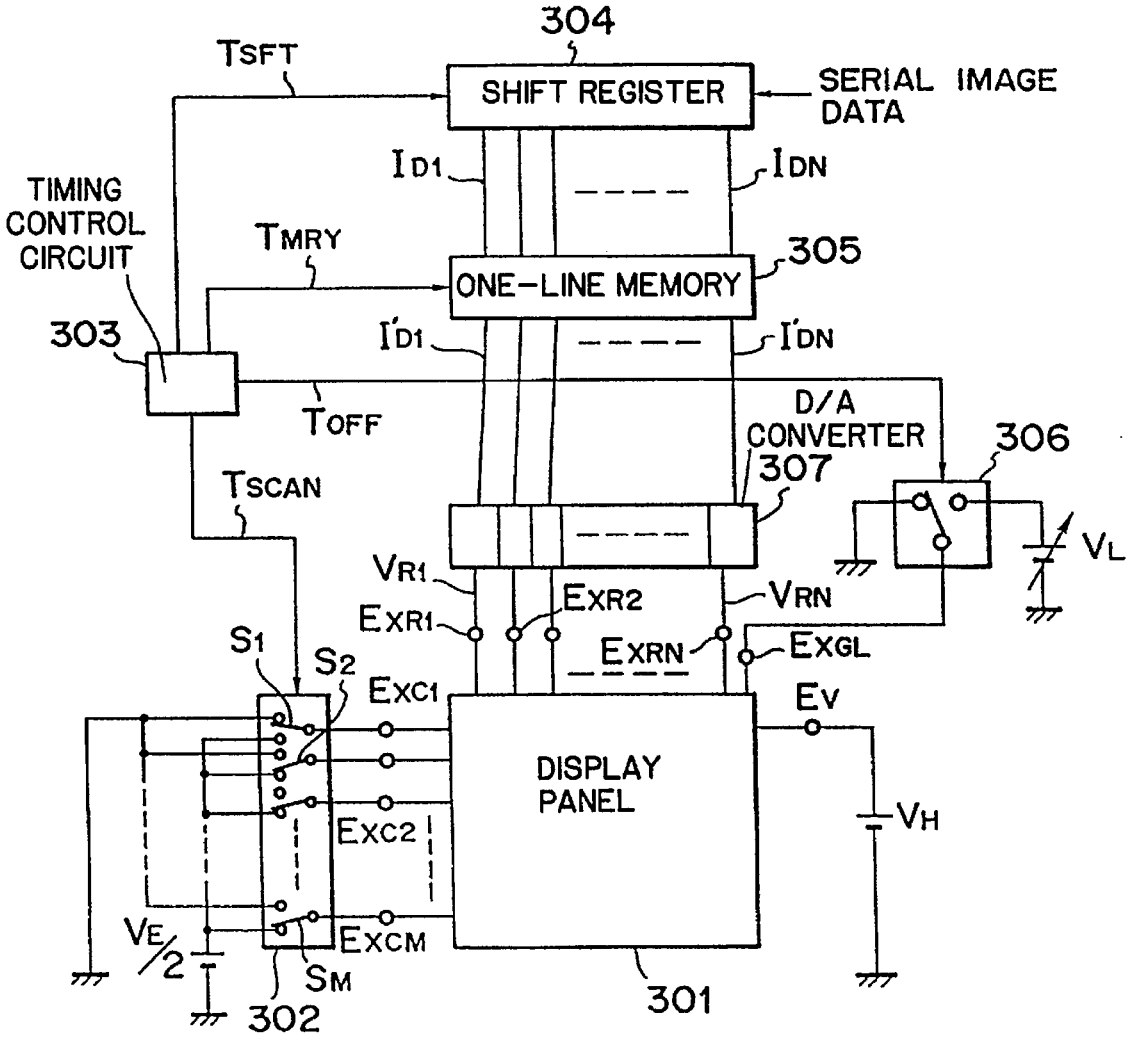
FIG. 24 is a simplified circuit diagram showing the basic constitution of Embodiment 4.

FIG. 24 shows a circuit construction of the flat plate type display apparatus of a fourth embodiment of the present invention. The apparatus comprises a display panel 301, a switching element array 302, a timing control circuit 303, a shift resistor 304, a one-line memory 305, a change-over switch 306, and D/A converters 307. The functions of the respective parts and the operation of the entire circuit are explained by reference to FIG. 25 and FIG. 26.

Figure 25:
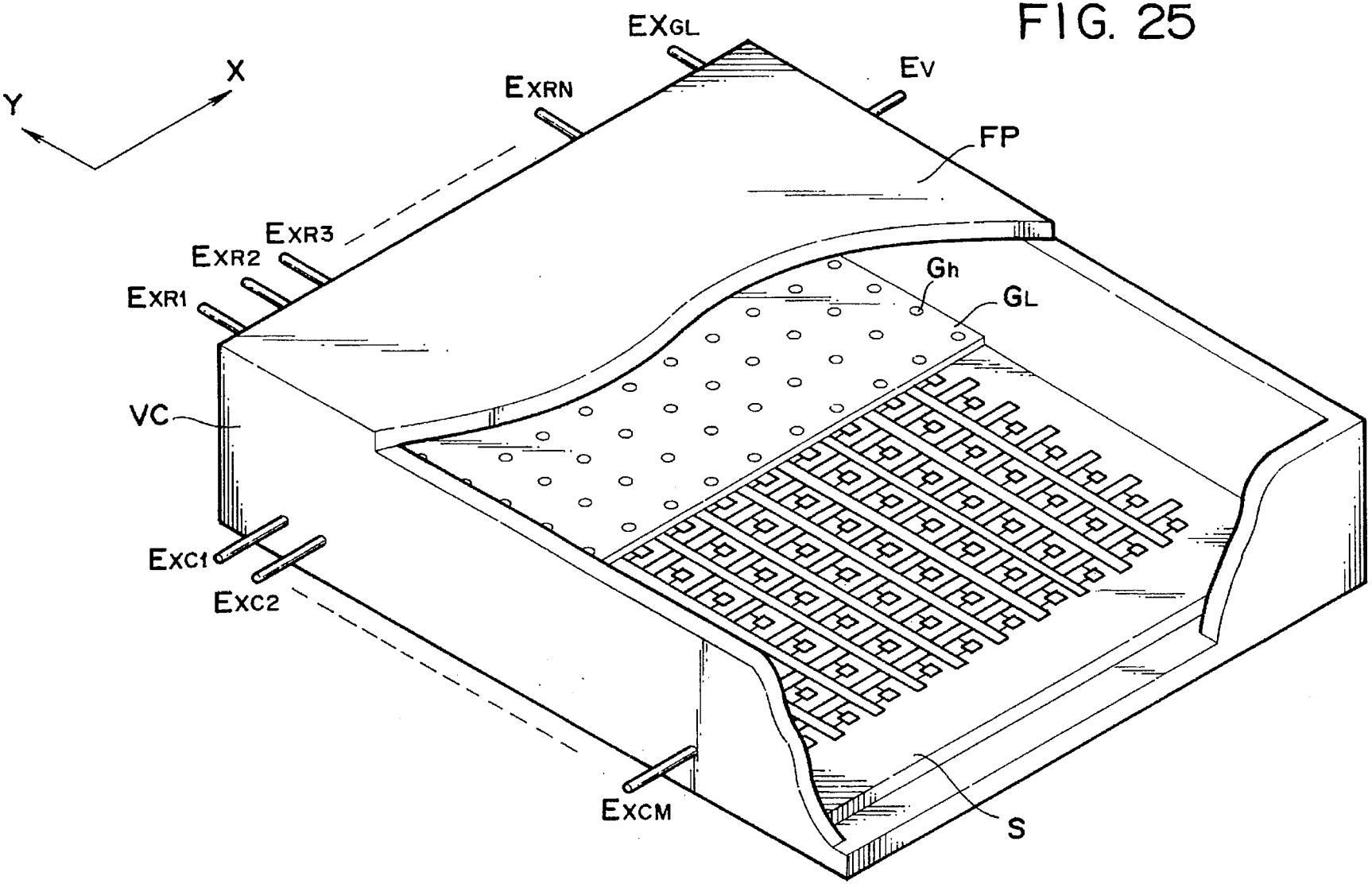
FIG. 25 is a partially cutaway perspective view of an example of a flat plate type display panel to which the present invention is applied.

The display panel 301, for example, is a flat plate type CRT like the one shown by a partially cutaway perspective view in FIG. 25. In FIG. 25, VC denotes a vacuum chamber made of glass, and FP, which is a portion of VC, denotes the face plate (or display screen) thereof. On the inside face of the face plate FP, a light-transmissive electrode is formed from a material like ITO, and further thereon, fluorescent materials of red, green, and blue are applied mosaically. The surface thereof is treated for metal back which is known in the field of CRT. (The light-transmissive electrode, the fluorescent materials, and the metal back are not shown in the drawing.) The vacuum chamber VC has an air-tight terminal EV, through which an accelerating voltage can be applied from a power source $V_H$ outside the vacuum chamber to the light-transmissive electrode and the metal back.

Figure 18:
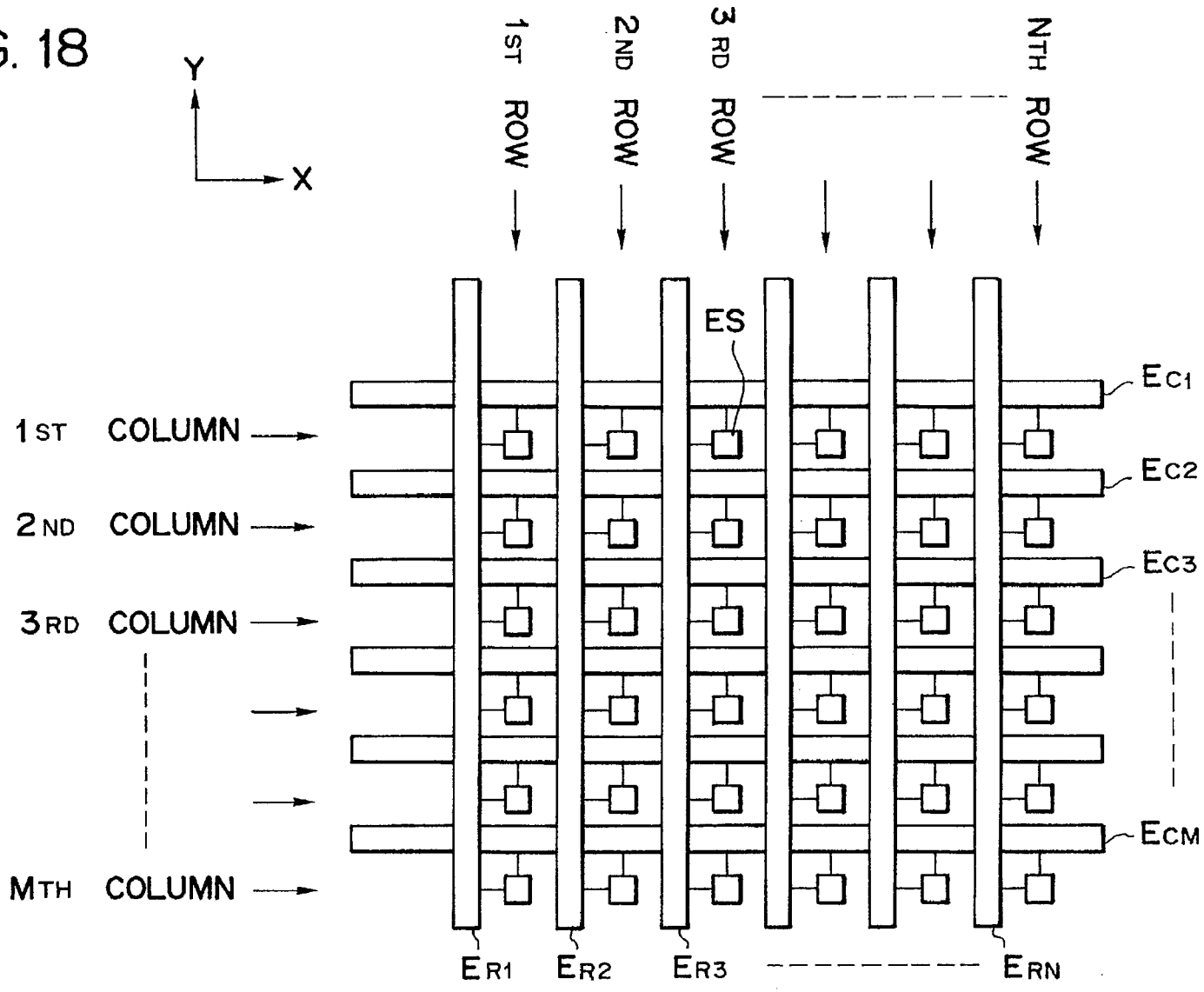
FIG. 18 shows the arrangement of electron-emitting elements in still another multi-electron beam source to which the present invention is applied.
Figure 19:
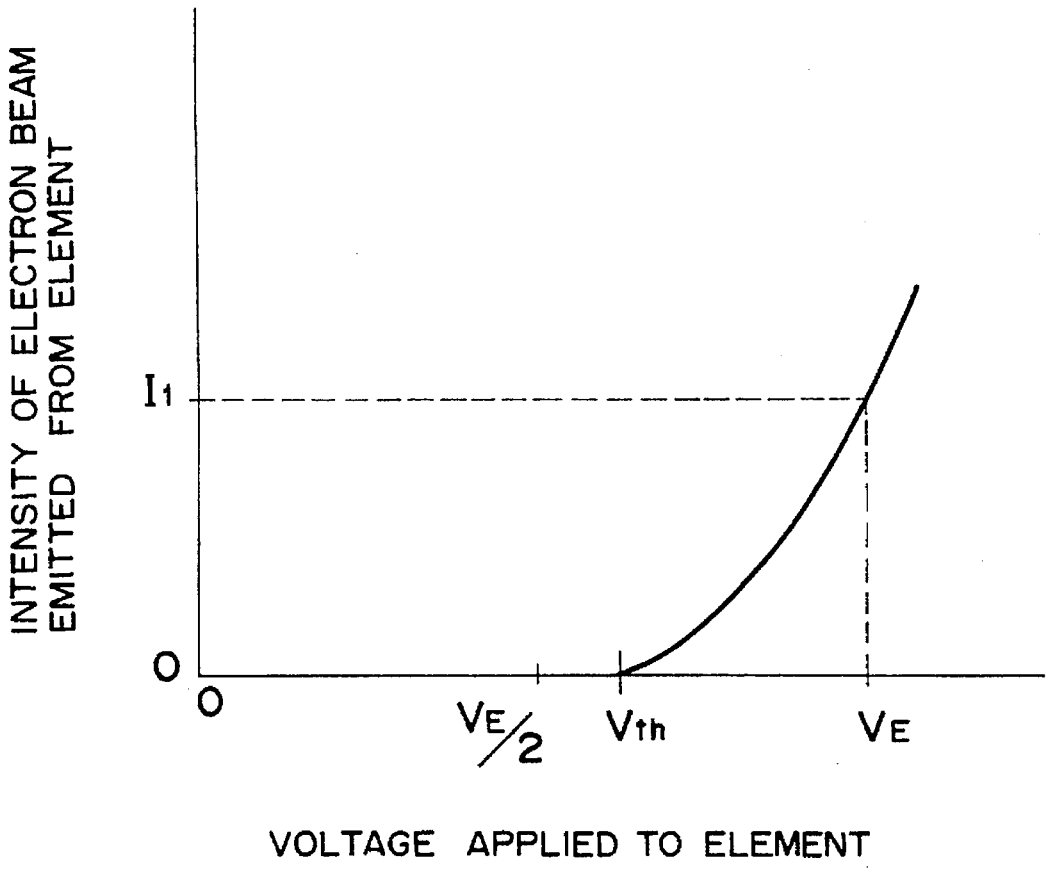
FIG. 19 is a graph showing a typical characteristic of an electron-emitting element.
Figure 20:
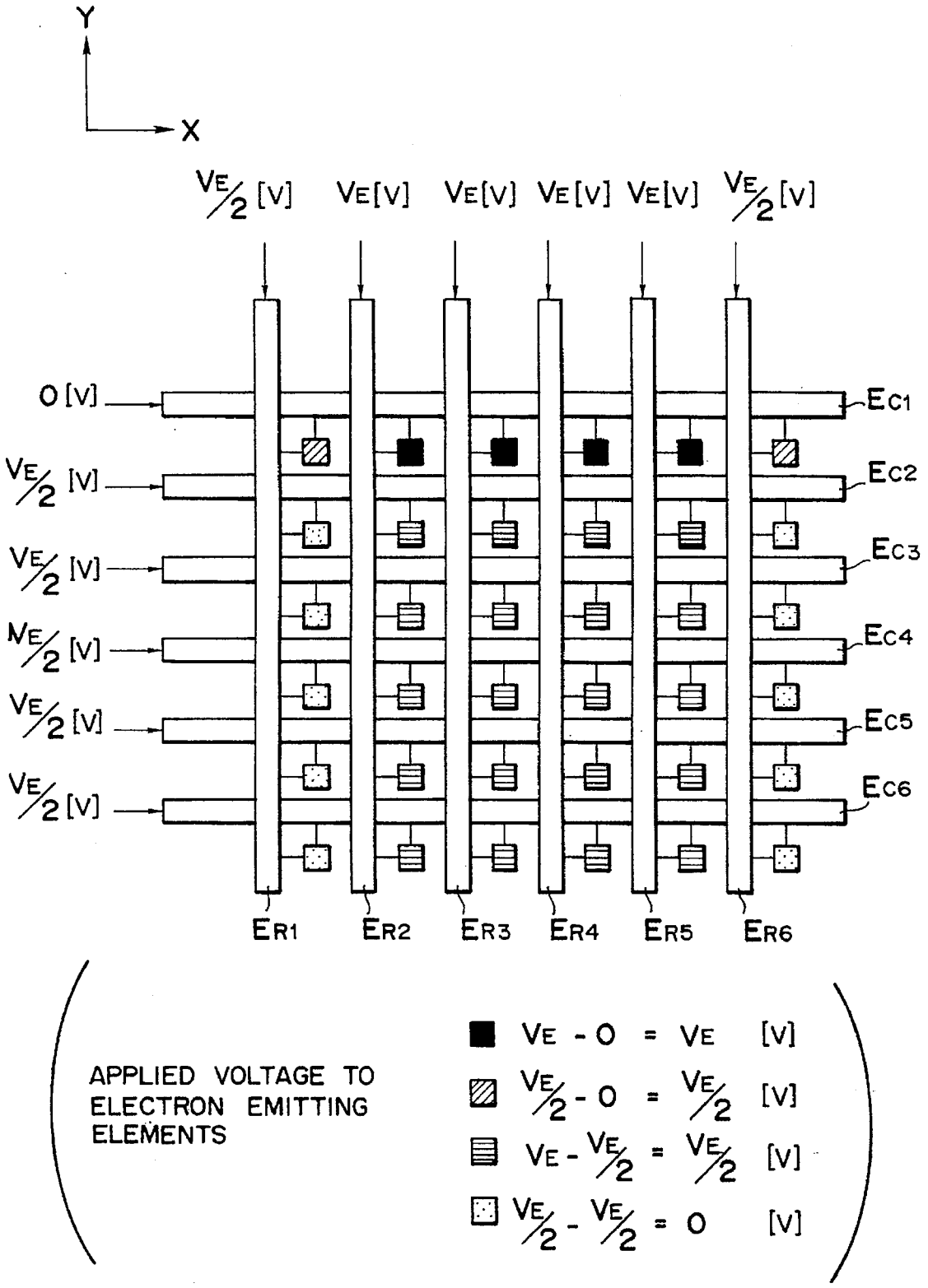
FIG. 20 is a drawing for explaining a method of application of voltage to the multi-electron beam source of FIG. 18.

A glass substrate S is fixed to the bottom of the vacuum chamber. On the upper face of the glass substrate, M×N electron-emitting elements are formed by a method as shown in FIG. 18. The electron-emitting elements are connected electrically in a simple matrix manner by wirings $E_{C1}$ to $E_{CM}$ and $E_{R1}$ to $E_{RN}$, and the wirings are connected electrically to the outside of the vacuum chamber through the air-tight terminals $E_{XC1}$ to $E_{XCM}$ and $E_{XR1}$ to $E_{XRN}$.

Between the substrate S and the face plate FP, a flat plate-shaped focusing grid electrode GL is provided parallel to the substrate S. The focusing grid electrode GL has through holes Gh corresponding to each of the electron-emitting elements on the substrate S. The focusing grid electrode GL, on application of an appropriate voltage $V_L$, serves as condenser lenses for electron beams emitted from the electron-emitting elements, thereby improving the shape of the luminescence spots on a fluorescent screen. The focusing grid electrode GL is connected electrically through the air-tight terminal $EX_{GL}$ to the outside of the vacuum chamber.

In this display panel, a number of electron-emitting elements are arranged in an XY matrix on the substrate. The columns of the electron-emitting elements are driven (scanned) sequentially, column by column, by application of a scanning signal, and synchronously modulation signals for the one line are applied to the N rows of wiring electrodes to control the irradiation of the electron beams onto the fluorescent screen, thereby an image being displayed sequentially in lines.

In FIG. 24, the terminal $E_V$ of the display panel 301 is connected to a high voltage source $V_H$ for application of accelerating voltage, e.g., 10 [KV].

Figure 21:
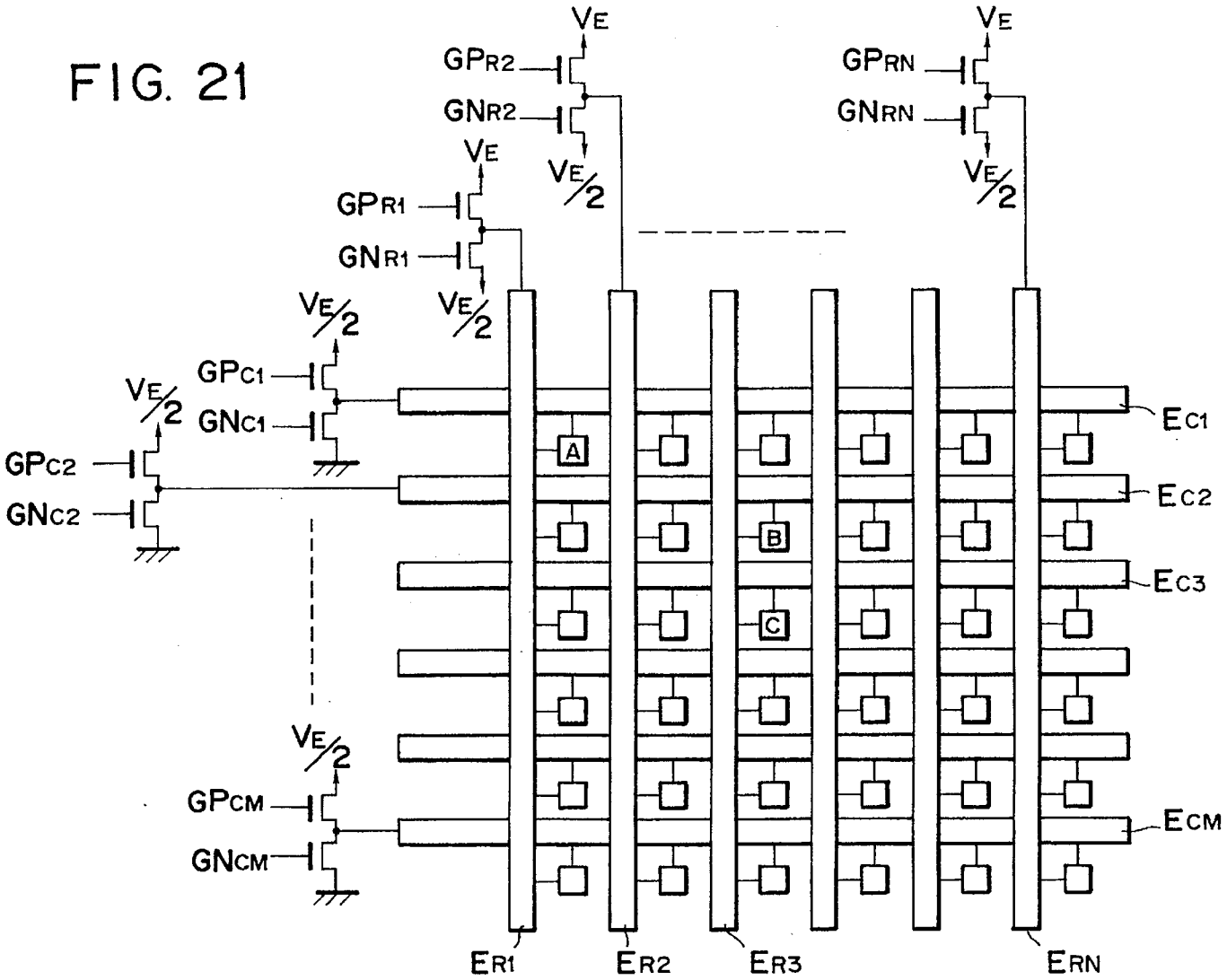
FIG. 21 shows an example of the driving circuit employed for the multi-electron beam source of FIG. 18.
Figure 22:
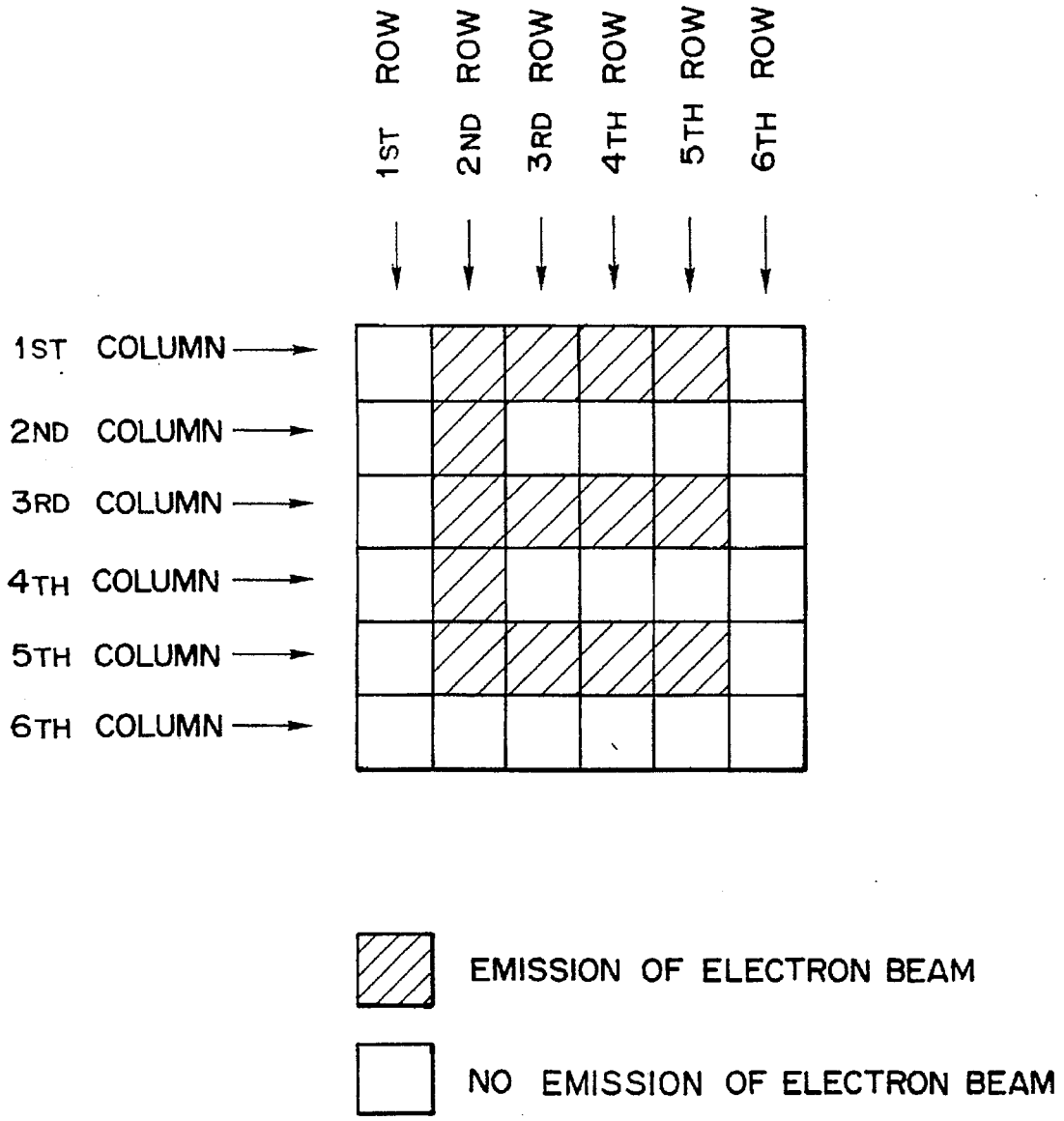
FIG. 22 shows an example of a driving pattern of the multi-electron beam source of FIG. 18.
Figure 23:
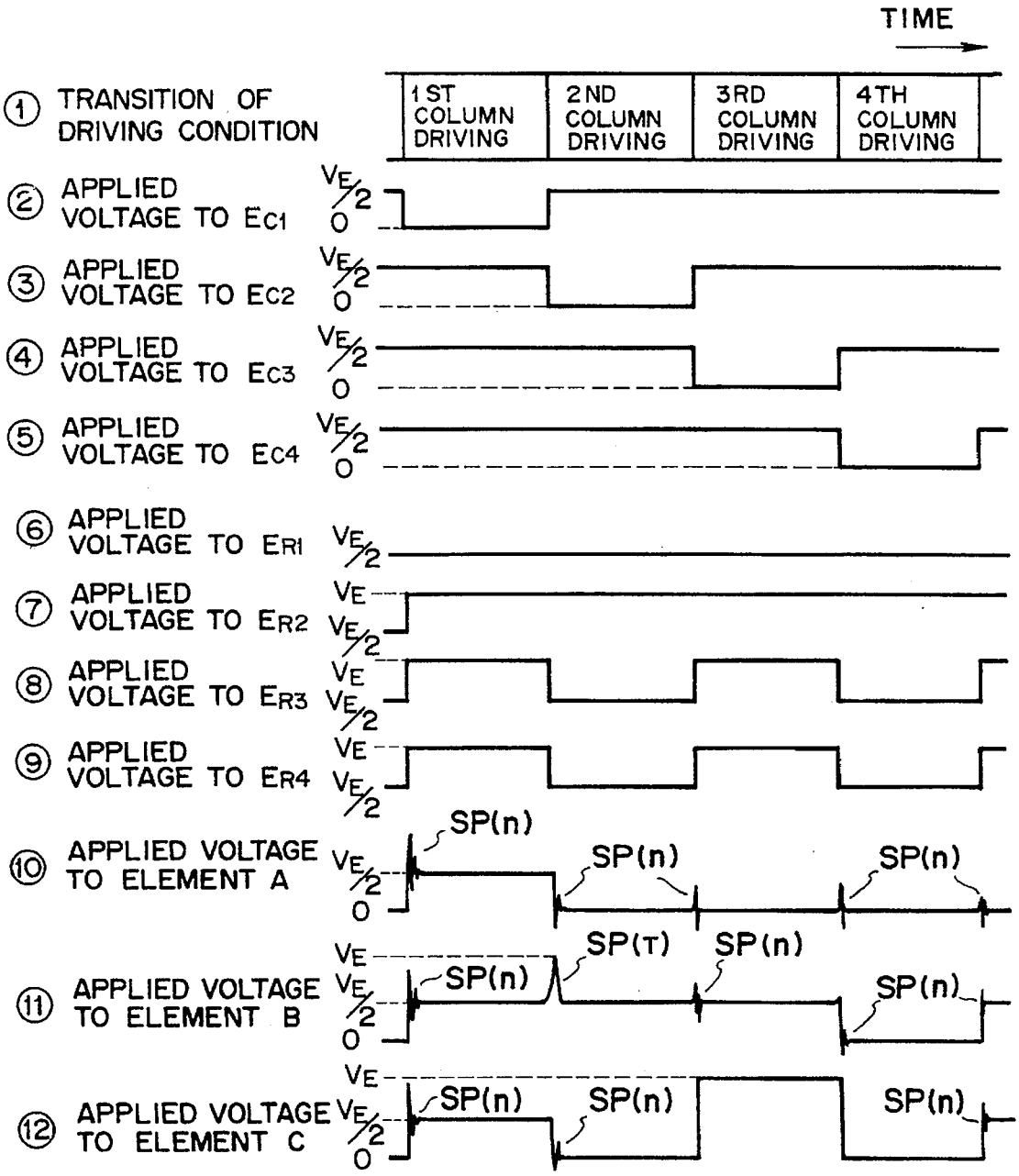
FIG. 23 is a time chart for explaining the spike noise encountered in a conventional multi-electron beam source.

The terminals, $E_{XC1}$ to $E_{XCM}$, are connected respectively to the switching elements, $S_1$ to $S_M$, of the switching element array 302. The switching elements respectively function to apply the ground level (0 [V]) or the output voltage of the power source $V_E/2$ selectively to the above terminals. In FIG. 24, the switching elements, $S_1$ to $S_M$, are shown schematically to constitute the switching element array 302. However, any type of switching element may be employed, provided that the element is capable of connecting ground level or power source $V_E/2$ selectively in accordance with control signals $T_{SCAN}$. For example, an FET pair may be used which is connected in a manner of a totem pole as shown in FIG. 21.

The shift register 304 conducts serial-parallel conversion of serial image data transmitted from the outside in accordance with the clock signal $T_{SFT}$ generated by a timing control circuit 303. Since the panel in this Embodiment has N picture elements for one line, the image data for the one line obtained by the serial-parallel conversion are outputted from the shift register 304 as N signals of $I_{D1}$ to $I_{DN}$. If each of the image data of $I_{D1}$ to $I_{DN}$ is given by 256 levels of gradation, it is outputted as 8-bit binary data from the shift register. In the drawing, the signal lines are denoted by single lines to simplify the drawing.

The line memory 305 latches one line of the image data outputted from the shift register 304 in accordance with the memory load timing signal $T_{MRY}$ generated by the timing control circuit 303. In FIG. 24, the output signals from the line memory 305 are shown by symbols $I'_{D1}$ to $I'_{DN}$.

The aforementioned output signals, $I'_{D1}$ to $I'_{DN}$, are converted to modulation signals, $V_{R1}$ to $V_{RN}$, by N-membered D/A converters 307 in accordance with the image data, and outputted. The signals, $V_{R1}$ to $V_{RN}$, are applied through the terminals, $E_{XR1}$ to $E_{XRN}$, to the row-direction wiring electrodes of the display panel 301.

The voltage source $V_L$ applies focusing potential to the focusing grid electrodes on the display panel 301.

The change-over switch 306 changes over the voltage applied to the focusing grid electrodes from the output voltage of the voltage source $V_L$ to the cutoff voltage (0 [V] in this Embodiment).

Figure 26:
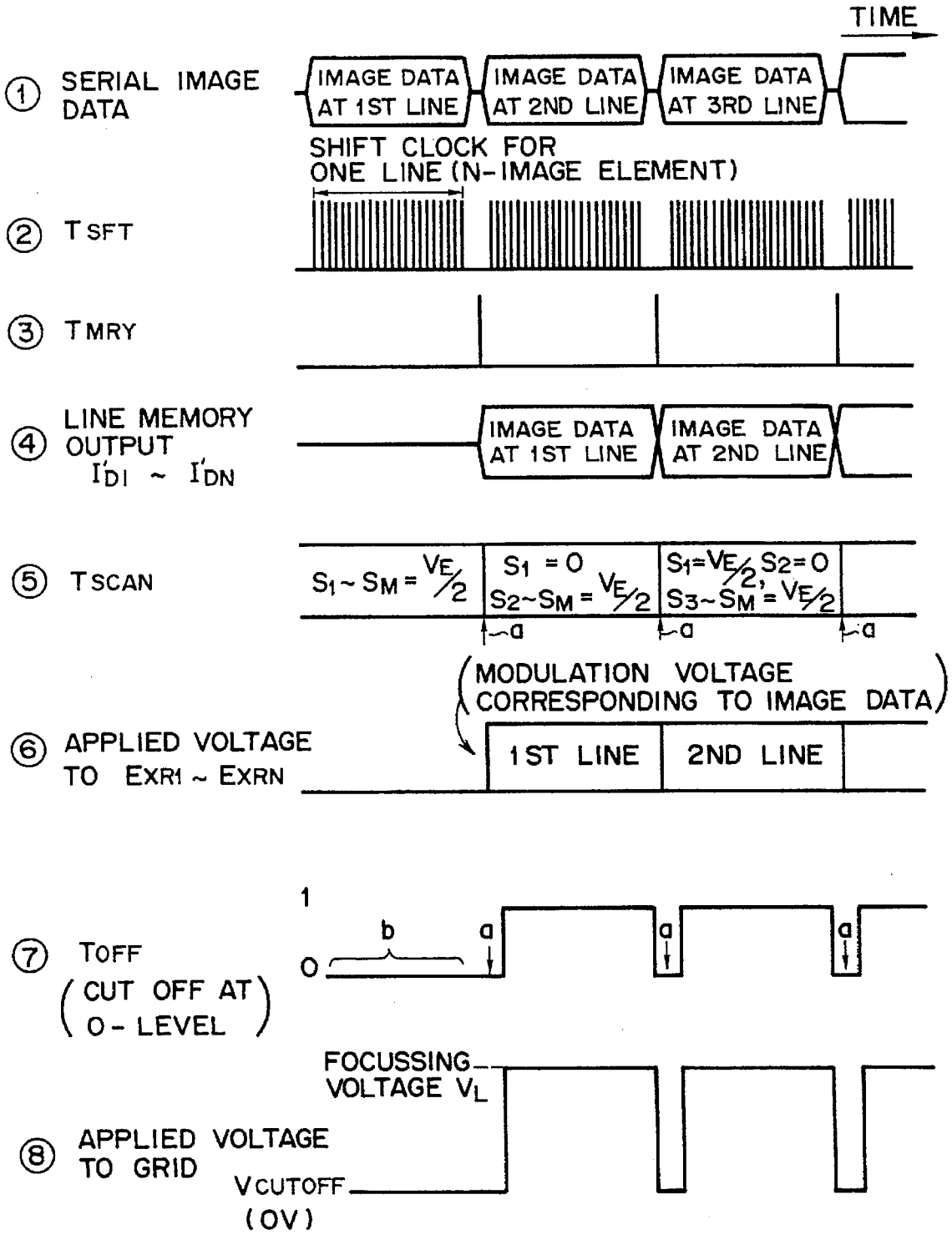
FIG. 26 shows time charts for explaining the operation in the example of FIG. 24.

The functions of the respective parts are explained above. Next, the operation of the entire device is explained by reference to the timing chart in FIG. 26. In FIG. 26, ① shows serial image data inputted from an image information source (not shown in the drawing) to the shift register 304 shown in FIG. 24. The serial image data are transmitted from the image information source successively in the line order: the first line data, the second line data, the third line data, and so forth (in the picture element order sequentially within the line). Synchronously with the above serial image data, a shift clock signal $T_{SFT}$ as shown by ② in FIG. 26 is sent from the timing control circuit 303 to the shift register 304. The shift register 304 conducts the serial-parallel conversion for the one line in accordance with the shift clock signal $T_{SFT}$. Synchronously with the completion of serial-parallel conversion, the timing circuit 303 generates a memory load timing signal $T_{MRY}$ to the one line memory 305, as shown by ③ in FIG. 26. Therefore, the output from the line memory 305 changes in the order of the first line image data, the second line image data, and so forth, synchronously with the above memory load timing signal $T_{MRY}$ as shown by ④ in FIG. 26.

The D/A converter 307 conducts D/A conversion of the image data of ④ and outputs modulation voltages for modulating the electron beam emitted from the electron-emitting elements with the timing shown by ⑥ in FIG. 26.

On the other hand, the timing control circuit 303 generates control signals $T_{SCAN}$ and sends the signals to the switching element array 302 to drive the electron-emitting element row to be displayed at an appropriate timing. The contents of the signals are shown by ⑤ in FIG. 26. In this drawing, for example, the indication "$S_1$=0" and "$S_2$~$S_M$=$V_E$/2" means that 0 [V] is selected by the switching element $S_1$, and $V_E$/2 [V] is selected by each of the switching elements of $S_2$ to $S_M$. By such operation of the switching elements, the electron-emitting columns are scanned sequentially from the first line with application of 0 [V] to the column-direction wiring electrode under scanning and $V_E$/2 [V] to the other column-direction wiring electrodes.

By the above driving steps, driving signals are applied to the electron-emitting elements in accordance with the image data. The driving signals are accompanied with the spike-like voltages SP as mentioned in the description of "Related Background Art". The spike-like voltage SP is generated synchronously with the instant when the switching element in the switching array 302 is switched over (at the time shown by the arrow mark a in ⑤ of FIG. 26). The time of duration of the spike-like voltage depends on the variation in the working speed of the switching element, and the electric circuit constant of the circuit from the switching element to the electron-emitting element row. In the present invention, control is made to apply a cutoff potential $V_{CUTOFF}$ to the focusing grid electrode to cut off the electron beam during the period in which the spike-like voltage is being applied to the electron-emitting element row. Preferably, the cutoff potential $V_{CUTOFF}$ is applied for a period of from at least 100 [ns] before to at least 100 [ns] after the occurrence of application of the spike-like voltage to the electron-emitting element row. In this embodiment, the control is conducted by inputting an appropriate cutoff timing signal $T_{OFF}$ to the change-over switch 306 in FIG. 24. At the zero level of $T_{OFF}$, the change-over switch 306 changes the connection to apply cutoff potential (ground level) to the terminal $EX_{GL}$. During that time the focusing grid electrode GL outputs the potential $V_{CUTOFF}$ to cut off the electron beam. In FIG. 26, ⑦ shows an example of the cutoff timing signal $T_{OFF}$ with denotation of the initiation point (arrow mark a) of the spike-like voltage shown in ⑤ of FIG. 26 above. $T_{OFF}$ is controlled to be at a zero level at least for a period of from 100 [ns] before the arrow mark to SP+100 [ns] after the arrow mark a. During the period denoted by b in ⑦ of FIG. 26, $T_{OFF}$ is controlled to be at a zero level for the purpose of keeping the focusing grid electrode in a cutoff state until the image data for the first line to be displayed has been set to the line memory 305. As the result of inputting the aforementioned cutoff timing signal $T_{OFF}$ to the change-over switch 306, the voltage is applied to the focusing grid as shown by ⑧ in FIG. 26.

By the above method, undesired electron beams caused by the spike-like voltage and emitted from the electron-emitting element rows are cut off and do not reach the fluorescent screen. Accordingly, the problems of high noise and low contrast of the image are completely solved. In this embodiment, the change-over switch 306 works at sufficient high speed, so that the cutoff timing $T_{OFF}$ is decided without adjusting the signal delay resulting from the working time. If the working speed is low, the cutoff timing needs to be advanced in correspondence with the working time relative to the arrow mark a in ⑤ of FIG. 26. In short, the electron source is required essentially to be constructed such that the cutoff potential is applied to the focusing grid electrode effectively during the time of from least 100 [ns] before to at least 100 [ns] after the period in which the spike-like voltage is being applied.

An example of preparation of the electron-emitting element (surface conduction type emitting element) employed in the above embodiments of the display apparatus is shown below.

Preparation of Electron-Emitting Elements

Figure 8A:
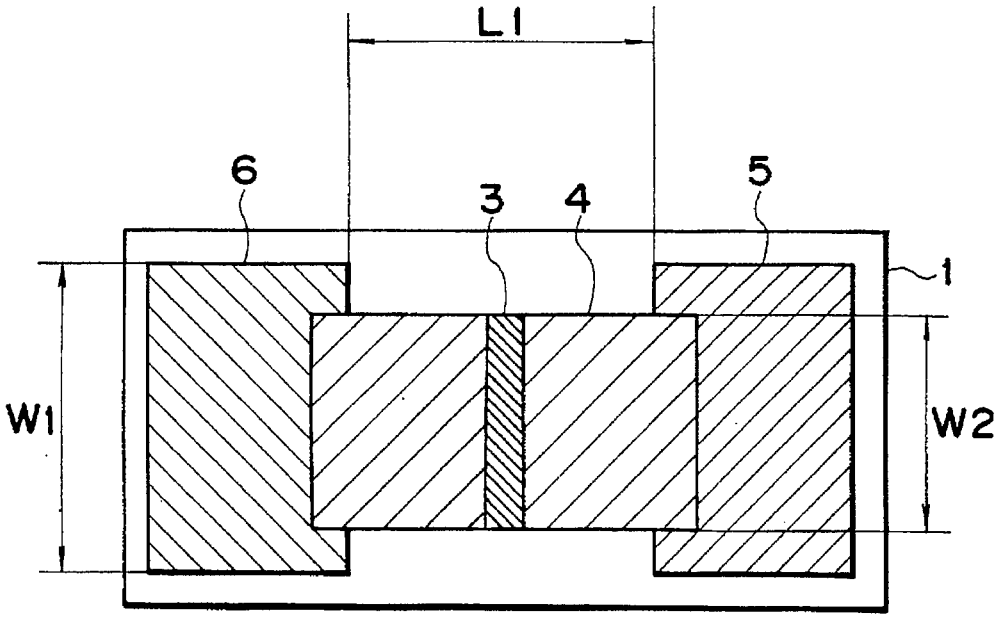
FIGS. 8A and 8B illustrate roughly the construction of the surface conduction type emitting element used in embodiments of the present invention.
Figure 8B:
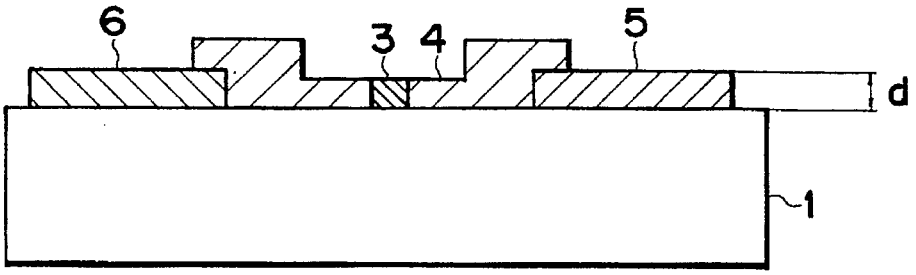

The electron-emitting elements of the above display apparatus examples are of the type shown in FIG. 8A (plan view)

and FIG. 8B (sectional side view). The element shown FIG. 8A and FIG. 8B has an insulating substrate 1, element electrodes 5 and 6 for applying voltage to the element, a thin film 4 comprising an electron-emitting portion 3. In the drawing, L1 denotes the spacing between the element electrodes 5 and 6; W1 the breadth of the element electrodes; d the thickness of the element electrodes; and W2 the breadth of the element.

Figure 9A:
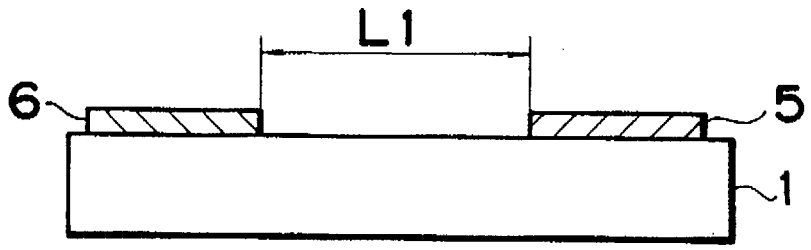
FIGS. 9A, 9B and 9C illustrate a process for preparing a surface conduction type emitting element used in embodiments of the present invention.

The process for producing the electron-emitting element employed in the above Embodiments is described by reference to FIG. 9A, FIG. 9B and FIG. 9C.

(1) A quartz plate was used as the insulating substrate 1. After the substrate was sufficiently cleaned with an organic solvent, the element electrodes 5 and 6 composed of nickel were formed on the face of the substrate 1 as shown in FIG. 9A. The spacing L1 between the element electrodes was 3 μm, the breadth W1 of the element electrodes was 500 μm, and the thickness d thereof was 1000 Å.

Figure 9B:
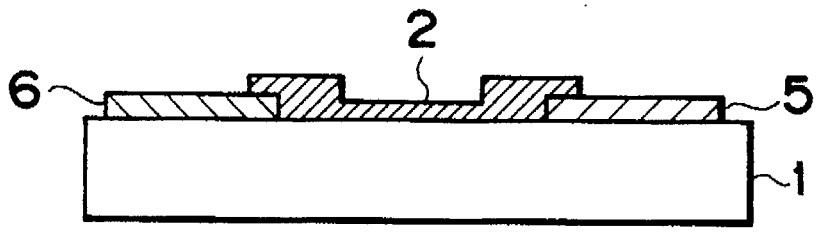

(2) Thereon, a solution containing an organic palladium (ccp-4230, made by Okuno Seiyaku K.K.) was applied, and the coated matter was heat-treated at 300° C. for 10 minutes to form a fine particle film composed of fine palladium oxide particles (PdO) having an average diameter of 70 Å as the thin film 2 for forming an electron-emitting portion as shown in FIG. 9B. The thin film 2 for electron-emitting portion formation was placed at about the center portion between the element electrodes 5 and 6. The thin film had a breadth W2 (breadth of the element) of 300 μm, a thickness of 100 Å, and sheet resistance of $5\times10^4$ Ω/□. The fine particle film mentioned herein is constructed of a plurality of assemblages of fine particles, and the fine structure includes a simple dispersion of isolated particles, a dispersion of groups of particles, and a dispersion of aggregated particles (including an island state). The particle diameter means the diameter of the particle of which the particle shape is discernible in the above dispersion state.

Figure 9C:
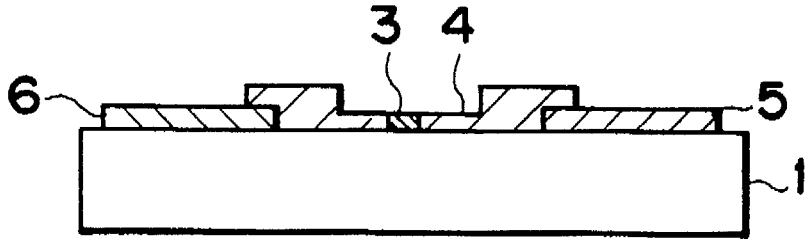
Figure 11:
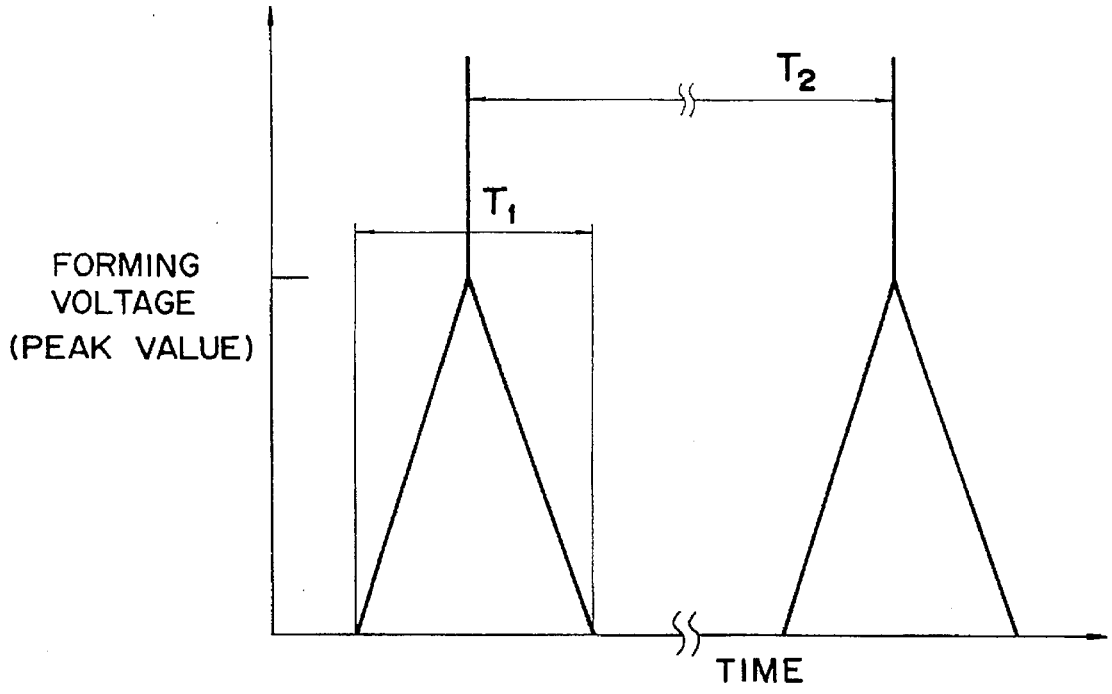
FIG. 11 shows a voltage waveform during forming treatment in preparation of surface conduction type emitting element used in embodiments of the present invention.

(3) The electron-emitting portion 3 was prepared by applying voltage between the element electrodes 5 and 6 to treat the above-mentioned thin film 2 with electric current (forming treatment) as shown in FIG. 9C. The voltage waveform at the forming treatment is shown in FIG. 11, where $T_1$ indicates the pulse width of the voltage waveform, and $T_2$ indicates the period of the pulses. In this embodiment, $T_1$ was 1 millisecond, $T_2$ was 10 milliseconds, and the wave height of the triangle (peak voltage in the forming treatment) was 5 volts. The forming treatment was conducted under a vacuum of about $1\times10^{-6}$ torr for 60 seconds. In the electron-emitting portion 3 thus prepared, particles mainly composed of palladium element were dispersed, and the average particle diameter was 30 Å.

Figure 10:
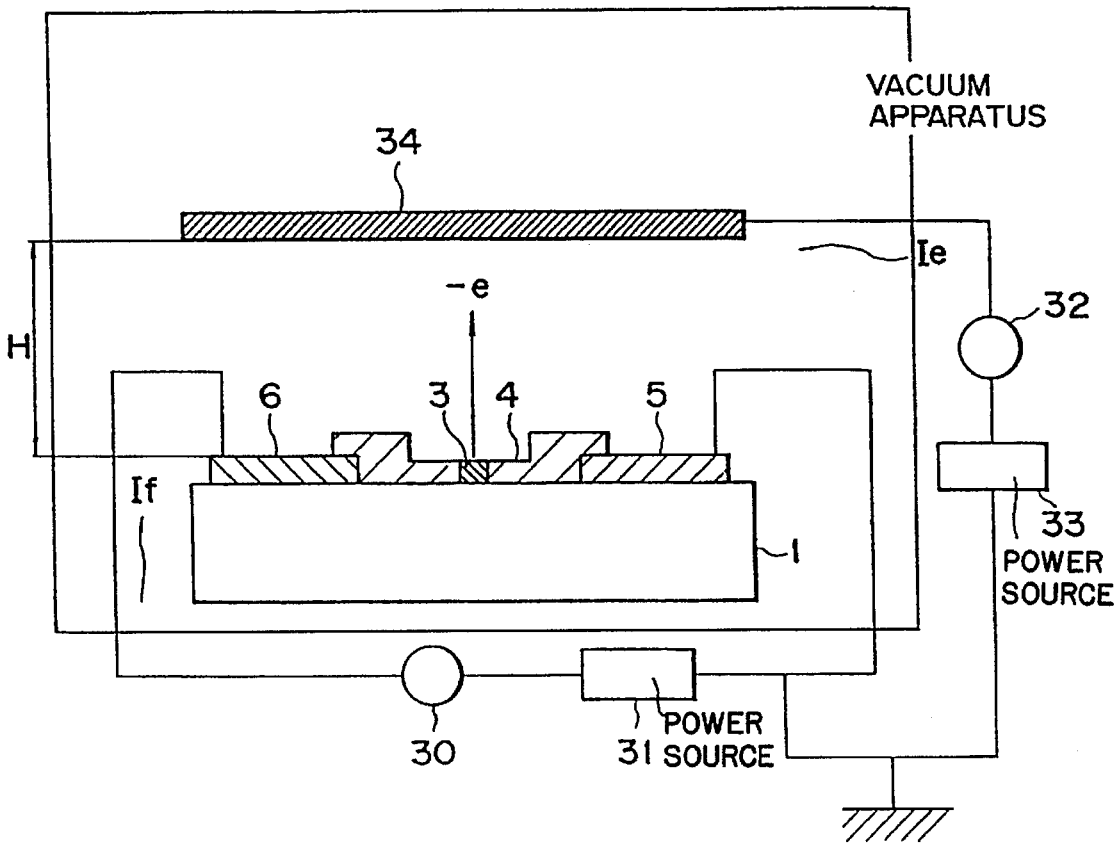
FIG. 10 illustrates roughly the evaluation apparatus for measuring the electron emitting characteristics of the surface conduction type emitting element used in embodiments of the present invention.

The element prepared as described above was subjected to measurement of electron-emitting characteristics. FIG. 10 illustrates schematically the constitution of the measurement apparatus.

In FIG. 10 also, the reference numeral 1 indicates an insulating substrate; 5 and 6 respectively an element electrode; 4 a thin film including an electron-emitting portion; and 3 an electron-emitting portion. Further, in FIG. 10, the reference numeral 31 indicates a power source for applying voltage to the element; 30 an ammeter for measuring an element current If; 34 an anode electrode for measuring an emitting current Ie generated by the element; 33 a high voltage source for applying voltage to an anode electrode 34; and 32 an ammeter for measuring the discharged current. For measurement of the element current If and the emitting current Ie, the power source 31 and the ammeter 30 are connected to the element electrodes 5 and 6, and the anode electrode 34 is placed which is connected to the power source 33 and the ammeter 32. The electron-emitting element and the anode electrode 34 are placed in a vacuum chamber which is provided with necessary equipment, not shown in the drawing, including a vacuum pump, a vacuum gauge, etc. Thereby the element is evaluated at a desired vacuum degree. In this embodiment, the distance between the anode electrode and the electron-emitting element was 4 mm, the potential of the anode electrode was 1 kV, and the vacuum degree in the vacuum chamber was $1\times10^{-6}$ torr in the measurement of the electron-emitting characteristics.

With the measurement apparatus, the element current If and the emitting current Ie were measured by applying an element voltage between the electrodes 5 and 6. With this element, at element voltage of 14 V, the element current If was 2.2 mA and the emitting current Ie was 1.1 μA, therefore the electron-emitting efficiency (η=Ie/If(%)) being 0.05%.

In forming the electron-emitting portion in the above embodiment, the forming treatment was conducted by applying triangle pulse voltage between the element electrodes. However, the waveform of the voltage applied between the elements is not limited to the triangle wave, but may be any desired waveform voltage such as rectangular waveform voltage, and the wave height, the pulse width, the pulse interval, etc. may be any desired value provided that the electron-emitting portion is formed satisfactorily.

The electron-emitting element in the above embodiments is characterized by an electron-emitting portion which is formed by dispersing fine particles between the electrodes on a substrate. In this electron-emitting element, the electrode spacing L1 is preferably in the range of from 0.2 μm to 5 μm, and the average particle diameter of the fine particles in the electron-emitting portion 3 is preferably in the range of from 5 Å to 1000 Å. The above fine particles may be composed of a material other than palladium, the material including metals such as Nb, Mo, Rh, Hf, Ta, W, Re, Ir, Pt, Ti, Au, Ag, Cu, Cr, Al, Co, Ni, Fe, Pb, Cs, and Ba; borides such as $LAB_6$, $CeB_6$, $HfB_4$, and $GdB_4$, carbides such as TiC, ZrC, HfC, TaC, SiC, and WC; nitrides such as TiN, ZrN, and HfN; metal oxides such as PdO, $Ir_2O_3$, $SnO_2$, and $Sb_2O_3$; semiconductors such as Si and Ge; carbon, alloys such as AgMg, NiCu, and the like.

As described above, the multi-electron beam source and the image display device of the present invention enable elimination of undesired emitting electron beam, and thereby offsetting completely the disadvantages of low contrast and crosstalk in the displayed image, and increasing greatly the usefulness of the flat panel type display apparatus.

Though in the above embodiment, the electron-emitting part is illustrated as having surface conduction type electron-emitting elements, the electron-emitting element in the present invention is not limited thereto, but may be an MIM type element.

The electron-emitting elements may be of an FE type.

What is claimed is:

1. A multi-electron beam source comprising:

an electron-emitter including a plurality of electron-emitting elements provided two-dimensionally in a matrix-like arrangement on a substrate, opposing terminals of said electron-emitting elements arranged adjacently in the column direction thereof being electrically connected to each other, terminals on the same side of said electron-emitting elements in the same row being electrically connected, and said plurality of electron-emitting elements being arranged in "m" rows, "m" representing a number of two or more;

a driving circuit for driving said electron-emitter;

grid electrodes for modulating electron beams emitted from said electron-emitting elements; and cut-off means for cutting off the electron beams caused by spike noises superposed on a driving pulse generated by said driving circuit.

2. A multi-electron beam source according to claim 1, wherein said cut-off means applies a cut-off voltage to said grid electrodes to cut off the electron beam at the time of ON/OFF switching at said driving circuit.

3. A multi-electron beam source according to claim 1, wherein said cut-off means applies a cut-off voltage to said grid electrodes to cut off the electron beam for at least the period of time when a spike-like voltage is applied to one of said electron-emitting elements.

4. An image display device comprising:

an electron-emitter including a plurality of electron-emitting elements provided two-dimensionally in a matrix-like arrangement on a substrate, opposing terminals of said electron-emitting elements arranged adjacently in the column direction thereof being electrically connected to each other, terminals on the same side of all said electron-emitter elements in the same row being electrically connected, and said plurality of electron-emitting elements being arranged in "m" rows, "m" representing a number of two or more;

a driving circuit for driving said electron-emitter;

grid electrodes for modulating electron beams emitted from said electron-emitting elements;

cut-off means for cutting off the electron beams caused by spike noises superposed on a driving pulse generated by said driving circuit; and a fluorescent material target for making an image visible by irradiation of electron beams provided above said electron-emitter.

5. An image display device according to claim 4, wherein said cut-off means applies a cut-off voltage to said grid electrodes to cut off the electron beam at the time of ON/OFF switching at said driving circuit.

6. An image display device according to claim 4, wherein said cut-off means applies a cut-off voltage to said grid electrodes to cut off the electron beam for at least the period of time when a spike-like voltage is applied to one of said electron-emitting elements.

7. A multi-electron beam source, comprising:

L rows of a plurality of electron-emitting elements, each electron-emitting element of the same row being electrically connected in parallel with two wiring electrodes, formed on a substrate;

a driving circuit for applying driving signals independently to the respective L electron-emitting element rows;

a grid electrode for modulating electron beams emitted from said electron-emitting elements; and means for cutting off the electron beams emitted from said electron-emitting elements caused by spike-like voltage superposed upon a driving signal generated by said driving circuit.

8. A multi-electron beam source according to claim 7, wherein said cutoff means applies a cutoff voltage to said grid electrode to cut off the electron beams at the time of ON/OFF switching at said driving circuit.

9. A multi-electron beam source according to claim 7, wherein said cutoff means applies a cutoff voltage to said grid electrode to cut off the electron beams at least during a period in which a spike-like voltage is being applied to one of said electron-emitting elements.

10. An image display device, comprising:

a multi-electron beam source including L rows of a plurality of electron-emitting elements, each electron-emitting element of the same row being electrically connected in parallel with two Wiring electrodes, formed on a substrate;

a driving circuit for applying driving signals independently to the respective L electron-emitting element rows;

a grid electrode for modulating electron beams emitted from said electron-emitting elements; and means for cutting off the electron beams emitted from said electron-emitting elements caused by spike-like voltage superposed upon a driving signal generated by said driving circuit; and a fluorescent material target for making an image visible by irradiation of electron beams provided above said multi-electron beam source.

11. An image display device according to claim 10, wherein said cutoff means applies a cutoff voltage to said grid electrode to cut off the electron beam at the time of ON/OFF switching at said driving circuit.

12. An image display device according to claim 10, wherein said cutoff means applies a cutoff voltage to said grid electrode to cut off the electron beam at least during a period in which a spike-like voltage is being applied to one of said electron-emitting elements.

* * * * *

UNITED STATES PATENT AND TRADEMARK OFFICE

CERTIFICATE OF CORRECTION

PATENT NO. : 5,627,436

DATED : May 6, 1997

INVENTOR(S) : Suzuki et al.

It is certified that error appears in the above-indentified patent and that said Letters Patent is hereby corrected as shown below:

COLUMN 11:

Line 56, "$\tau_{max}$)." should read --$\tau_{smax}$).--.
Line 58, "$\tau_{max}$" should read --$\tau_{smax}$--.
Line 59, "O<SP<$\tau_{max}$." should read --O<SP<$\tau_{smax}$.--.

COLUMN 22:

Line 27, "Wiring" should read --wiring--.

Signed and Sealed this

Twenty-fourth Day of February, 1998

Bruce Lehman

*Attest:*

BRUCE LEHMAN

*Attesting Officer*

*Commissioner of Patents and Trademarks*